US009076301B2

(12) United States Patent
Okada

(10) Patent No.: US 9,076,301 B2
(45) Date of Patent: Jul. 7, 2015

(54) GAMING MACHINE DISPLAYING PREDETERMINED IMAGES FOR DISPLAYING A BONUS SYMBOL AT A PREDETERMINED POSITION

(75) Inventor: Kazuo Okada, Tokyo (JP)

(73) Assignee: ARUZE GAMING AMERICA, INC., Las Vegas, NV (US)

( * ) Notice: Subject to any disclaimer, the term of this patent is extended or adjusted under 35 U.S.C. 154(b) by 1377 days.

(21) Appl. No.: 12/038,452

(22) Filed: Feb. 27, 2008

(65) Prior Publication Data

US 2009/0082084 A1 Mar. 26, 2009

Related U.S. Application Data

(60) Provisional application No. 60/960,280, filed on Sep. 24, 2007.

(51) Int. Cl.
*G07F 17/32* (2006.01)
*G07F 17/34* (2006.01)

(52) U.S. Cl.
CPC ..... *G07F 17/326* (2013.01); *G07F 17/3227* (2013.01); *G07F 17/3244* (2013.01); *G07F 17/34* (2013.01)

(58) Field of Classification Search
USPC ..... 463/16, 22, 26–27
See application file for complete search history.

(56) References Cited

U.S. PATENT DOCUMENTS 4,772,023 A * 9/1988 Okada ..... 273/143 R
5,833,537 A * 11/1998 Barrie ..... 463/21
6,142,874 A * 11/2000 Kodachi et al. ..... 463/20
6,142,875 A * 11/2000 Kodachi et al. ..... 463/20
6,206,781 B1 * 3/2001 Sunaga et al. ..... 463/20
6,287,194 B1 * 9/2001 Okada et al. ..... 463/16
6,398,217 B1 * 6/2002 Shimizu et al. ..... 273/121 B
6,506,116 B1 * 1/2003 Sunaga et al. ..... 463/20
6,517,433 B2 * 2/2003 Loose et al. ..... 463/20
6,669,561 B2 * 12/2003 Sunaga et al. ..... 463/20
6,682,073 B2 * 1/2004 Bryant et al. ..... 273/138.1
7,169,046 B2 * 1/2007 Webb et al. ..... 463/20
7,628,693 B2 * 12/2009 Thomas ..... 463/20
8,512,141 B2 * 8/2013 Pryzby et al. ..... 463/35
2003/0130034 A1 * 7/2003 Suganuma et al. ..... 463/30
2003/0157978 A1 * 8/2003 Englman ..... 463/16
2004/0152502 A1 * 8/2004 Okada ..... 463/16
2005/0143164 A1 * 6/2005 Duhamel et al. ..... 463/20
2006/0025203 A1 * 2/2006 Thomas ..... 463/20
2006/0073881 A1 * 4/2006 Pryzby et al. ..... 463/20
2008/0004103 A1 * 1/2008 Kojima ..... 463/20
2008/0146324 A1 * 6/2008 Anderson ..... 463/25
2008/0200246 A1 * 8/2008 Anderson ..... 463/31

(Continued)

*Primary Examiner* — Bach Hoang
(74) *Attorney, Agent, or Firm* — Lexyoume IP Meister, PLLC

(57) ABSTRACT

A gaming machine 13 determines a position of a symbol statically displayed corresponding to a random number thus generated, statically displays the video reels 3A to 3E which were rotationally displayed in sequence, in a case where a bonus game is statically displayed, displays an image corresponding to the total number of the bonus symbols statically displayed on the display every time the video reels 3A to 3E are statically displayed. Furthermore, in a case where the total number of the bonus symbols which were statically displayed is a predetermined number, and when the bonus symbol included in a video reel to be statically displayed next is determined to be stopped at a predetermined stop position, displays a predetermined image on the display while the video reel to be statically displayed next is being rotationally displayed.

10 Claims, 17 Drawing Sheets

(56) References Cited

U.S. PATENT DOCUMENTS

2009/0209317 A1* 8/2009 Gomez ..... 463/20
2010/0048284 A1* 2/2010 Jaffe ..... 463/20
2010/0113131 A1* 5/2010 Aoki et al. ..... 463/20
2011/0159947 A1* 6/2011 Kojima ..... 463/20
2012/0184348 A1* 7/2012 Anderson ..... 463/20

* cited by examiner

FIG. 7

SYMBOL ARRANGEMENT TABLE

| SYMBOL POSITION | SYMBOL | | | | |
|---|---|---|---|---|---|
| | FIRST REEL | SECOND REEL | THIRD REEL | FOURTH REEL | FIFTH REEL |
| 20 | BONUS | BONUS | BONUS | BONUS | BONUS |
| 19 | A | MASK | Q | A | 10 |
| 18 | HOLY CUP | K | K | TREASURE | SNAKE |
| 17 | TREASURE | COMPASS | 10 | Q | HOLY CUP |
| 16 | Q | MASK | K | K | J |
| 15 | 10 | Q | TREASURE | MASK | TREASURE |
| 14 | HOLY CUP | HOLY CUP | HOLY CUP | BONUS | WILD |
| 13 | MASK | J | J | Q | Q |
| 12 | 10 | BONUS | BONUS | SNAKE | HOLY CUP |
| 11 | TREASURE | HOLY CUP | TREASURE | 10 | A |
| 10 | WILD | A | WILD | WILD | WILD |
| 9 | BONUS | Q | COMPASS | 10 | A |
| 8 | MASK | WILD | A | BONUS | 10 |
| 7 | J | A | 10 | Q | TREASURE |
| 6 | HOLY CUP | J | J | COMPASS | MASK |
| 5 | TREASURE | K | HOLY CUP | Q | 10 |
| 4 | A | TREASURE | TREASURE | K | TREASURE |
| 3 | Q | A | WILD | Q | K |
| 2 | COMPASS | HOLY CUP | TREASURE | HOLY CUP | COMPASS |
| 1 | 10 | TREASURE | K | A | TREASURE |
| 0 | K | Q | TREASURE | Q | MASK |

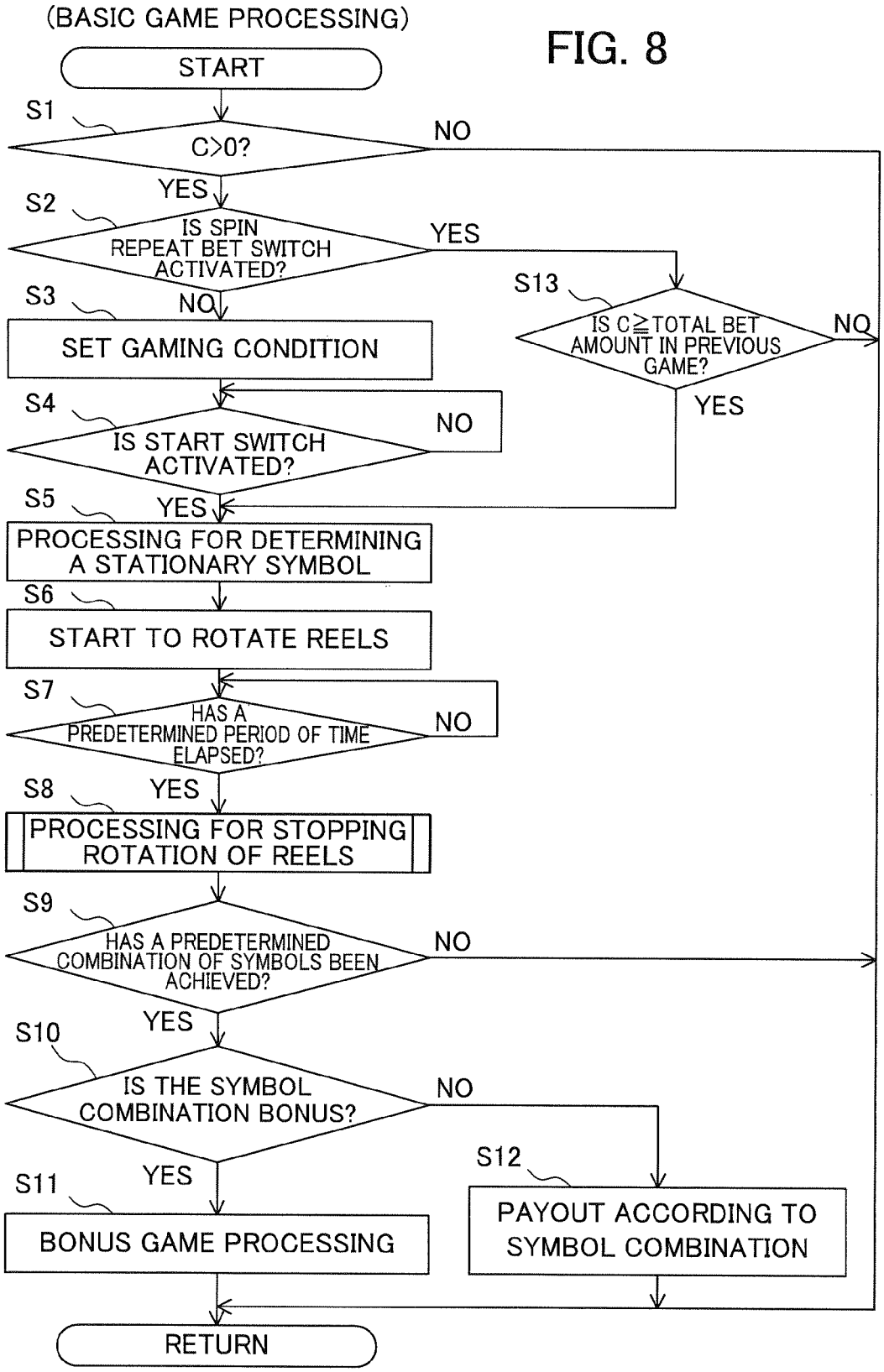
(BASIC GAME PROCESSING)
FIG. 8
START
S1
C>0?
NO
YES
S2
IS SPIN REPEAT BET SWITCH ACTIVATED?
YES
S13
IS C≧TOTAL BET AMOUNT IN PREVIOUS GAME?
NO
YES
S3
NO
SET GAMING CONDITION
S4
IS START SWITCH ACTIVATED?
NO
S5
YES
PROCESSING FOR DETERMINING A STATIONARY SYMBOL
S6
START TO ROTATE REELS
S7
HAS A PREDETERMINED PERIOD OF TIME ELAPSED?
NO
S8
YES
PROCESSING FOR STOPPING ROTATION OF REELS
S9
HAS A PREDETERMINED COMBINATION OF SYMBOLS BEEN ACHIEVED?
NO
YES
S10
IS THE SYMBOL COMBINATION BONUS?
NO
YES
S11
BONUS GAME PROCESSING
S12
PAYOUT ACCORDING TO SYMBOL COMBINATION
RETURN (PROCESSING FOR STOPPING ROTATION OF REELS)

FIG. 10

NOTICE EFFECT MODES TABLE

| VALUE OF BONUS SYMBOL COUNTER | NOTICE EFFECT MODES |
|---|---|
| 0 | NONE |
| 1 | APPEARANCE OF A PENGUIN |
| 2 | A PENGUIN GOES INTO THE SEA |
| 3 | A PENGUIN JUMPS OUT FROM THE SEA |
| 4 OR MORE | NONE |

GAMING MACHINE DISPLAYING PREDETERMINED IMAGES FOR DISPLAYING A BONUS SYMBOL AT A PREDETERMINED POSITION

CROSS-REFERENCE TO RELATED APPLICATIONS

This application is based on and, under 35 U.S.C. §119(e), claims the priority benefit of U.S. Provisional Patent Application Ser. No. 60/960,280 filed Sep. 24, 2007.

BACKGROUND OF THE INVENTION

1. Field of the Invention

The present invention relates to a gaming machine which displays a predetermined image in displaying a bonus symbol at a predetermined position.

2. Related Art

It is known that conventional slot machines have a function whereby a game is started when a predetermined amount of credits is bet, a plurality of reels on which a plurality of symbols are arranged are then started to rotate, and the rotations of the plurality of the reels are stopped after a predetermined amount of time elapses. Consequently, an award is provided to a player based on a symbol combination which is statically displayed. U.S. Pat. No. 6,517,433 discloses that, to improve a fault of lacking dynamic expressions on a display, a video display is disposed in front of rotational reels to provide a video image superimposed upon the rotational reels so as to associate images that provide visual effects, including information regarding games with images of the reels each other, thereby producing novel and powerful effects in games.

The present invention provides a gaming machine with new entertainment properties.

SUMMARY OF THE INVENTION

In a first aspect of the present invention, a gaming machine includes: an input device for starting a basic game; and a controller configured with logic to: (a) generate a random number and start the basic game corresponding to the input to the input device; (b) rotationally display each of a plurality of symbol groups displayed on the display; (c) determine a position of a symbol statically displayed on the display corresponding to the random number thus generated; (d) statically display each of the plurality of symbol groups which was rotationally displayed in sequence on the display corresponding to the operation (c); (e) in a case where a bonus symbol is statically displayed, display an image corresponding to a total number of the bonus symbol statically displayed on the display every time the symbol groups are statically displayed; and (f) in a case where the total number of the bonus symbols, which were statically displayed, is a predetermined number, and when the bonus symbol included in a symbol group to be statically displayed next is determined to be stopped at a predetermined stop position, display a predetermined image on the display while the symbol group to be statically displayed next is being rotationally displayed.

In the first aspect of the present invention, the gaming machine according to the first aspect of the present invention (a) generates a random number and starts the basic game corresponding to the input to the input device; (b) rotationally displays each of the plurality of symbol groups displayed on the display; (c) determines a position of a symbol statically displayed on the display corresponding to the random number thus generated; (d) statically displays each of the plurality of symbol groups which were rotationally displayed in sequence on the display corresponding to the operation (c); (e) in a case where a bonus symbol is statically displayed, displays an image corresponding to the total number of the bonus symbols statically displayed on the display every time the symbol groups are statically displayed; and (f) in a case where the total number of the bonus symbols which were statically displayed is a predetermined number, and when the bonus symbol included in a symbol group to be statically displayed next is determined to be stopped at a predetermined stop position, displays a predetermined image on the display while the symbol group to be statically displayed next is being rotationally displayed.

The second aspect of the present invention is a gaming machine, that includes: a display for rotationally displaying each of a plurality of symbol groups having a plurality of symbols, a plurality of bonus symbols being arranged in each of the plurality of symbol groups; an input device for starting a basic game; and a controller configured with logic to: (a) generate a random number and start the basic game corresponding to the input to the input device; (b) rotationally display each of the plurality of symbol groups displayed on the display; (c) determine a position of a symbol which is statically displayed on the display corresponding to the random number thus generated; (d) statically display each of the plurality of symbol groups which were rotationally displayed in sequence on the display corresponding to the operation (c); (e) in a case where the bonus symbol is statically displayed, display an image corresponding to the total number of the bonus symbol statically displayed on the display every time the symbol groups are statically displayed; and (f) in a case where the total number of the bonus symbols which was statically displayed is a predetermined number, and when the bonus symbol arranged in a predetermined position among the plurality of the bonus symbols arranged in a symbol group to be statically displayed next is determined to be stopped at a predetermined stop position, display a predetermined image on the display while the symbol group to be statically displayed next is being rotationally displayed.

The gaming machine according to the second aspect of the present invention (a) generates a random number and starts the basic game corresponding to the input to the input device; (b) rotationally displays each of the plurality of symbol groups displayed on the display; (c) determines a position of a symbol statically displayed on the display corresponding to the random number thus generated; (d) statically displays each of the plurality of symbol groups which was rotationally displayed in sequence on the display corresponding to the operation (c); (e) in a case where the bonus symbol is statically displayed, displays an image corresponding to the total number of the bonus symbol which is statically displayed on the display every time the symbol groups are statically displayed; and (f) in a case where the total number of the bonus symbols which was statically displayed is a predetermined number, and when the bonus symbol arranged in a predetermined position among the plurality of the bonus symbols arranged in a symbol group to be statically displayed next is determined to be stopped at a predetermined stop position, displays a predetermined image on the display while the symbol group to be statically displayed next is being rotationally displayed.

In a third aspect of the present invention, a gaming machine includes: a display for rotationally displaying each of a plurality of symbol groups including a plurality of symbols; an input device for starting a basic game; and a controller configured with logic to: (a) generate a random number and start the basic game corresponding to the input to the input device;

(b) rotationally display each of the plurality of symbol groups displayed on the display; (c) determine a position of a symbol statically displayed on the display corresponding to the random number thus generated; (d) statically display each of the plurality of symbol groups which was rotationally displayed sequentially on the display corresponding to the operation (c); (e) in a case where a bonus symbol is statically displayed, display an image corresponding to the total number of the bonus symbol statically displayed on the display every time the symbol groups are statically displayed; (f) in a case where the total number of the bonus symbols which was statically displayed is a predetermined number, and when the bonus symbol included in a symbol group to be statically displayed next is determined to be stopped at a predetermined stop position, display a predetermined image on the display while the symbol group to be statically displayed next is being rotationally displayed; and (g) in a case where the total number of the bonus symbol which was statically displayed is more than the predetermined number when each of the plurality of symbol groups is displayed statically, start a bonus game.

The gaming machine according to the third aspect of the present invention (a) generates a random number and starts the basic game corresponding to the input to the input device; (b) rotationally displays each of the plurality of symbol groups displayed on the display; (c) determines a position of a symbol statically displayed on the display corresponding to the random number thus generated; (d) statically displays each of the plurality of symbol groups which was rotationally displayed in sequence on the display corresponding to the operation (c); (e) in a case where a bonus symbol is statically displayed, displays an image corresponding to the total number of the bonus symbol which is statically displayed on the display every time the symbol groups are statically displayed; (f) in a case where the total number of the bonus symbols which were statically displayed is a predetermined number, and when the bonus symbol included in a symbol group to be statically displayed next is determined to be stopped at a predetermined stop position, displays a predetermined image on the display while the symbol group to be statically displayed next is being rotationally displayed; and (g) in a case where the total number of the bonus symbol which was statically displayed is more than the predetermined number when each of the plurality of symbol groups is displayed statically, starts a bonus game.

In a fourth aspect of the present invention, a gaming machine includes: a display for rotationally displaying each of a plurality of symbol groups including a plurality of symbols, a plurality of bonus symbols being arranged in each of the plurality of symbol groups; an input device for starting a basic game; and a controller configured with logic to: (a) generate a random number and start the basic game corresponding to the input to the input device; (b) rotationally display each of the plurality of symbol groups displayed on the display; (c) determine a position of a symbol statically displayed on the display corresponding to the random number thus generated; (d) statically display each of the plurality of symbol groups which were rotationally displayed in sequence on the display corresponding to the operation (c); (e) in a case where the bonus symbol is statically displayed, display an image corresponding to the total number of the bonus symbol which is statically displayed on the display every time the symbol groups are statically displayed; (f) in a case where the total number of the bonus symbols which was statically displayed is a predetermined number, and when the bonus symbol arranged in a predetermined position among the plurality of the bonus symbols which are arranged in a symbol group to be statically displayed next is determined to be stopped at a predetermined stop position, display a predetermined image on the display while the symbol group to be statically displayed next is being rotationally displayed; and (g) in a case where the total number of the bonus symbol which was statically displayed is more than the predetermined number when each of the plurality of symbol groups is displayed statically, start a bonus game.

The gaming machine according to the fourth aspect of the present invention (a) generates a random number and starts the basic game corresponding to the input to the input device; (b) rotationally displays each of the plurality of symbol groups displayed on the display; (c) determines a position of a symbol which is statically displayed on the display corresponding to the random number thus generated; (d) statically displays each of the plurality of symbol groups which were rotationally displayed in sequence on the display corresponding to the operation (c); (e) in a case where the bonus symbol is statically displayed, displays an image corresponding to the total number of the bonus symbol which is statically displayed on the display every time the symbol groups are statically displayed; (f) in a case where the total number of the bonus symbols which was statically displayed is a predetermined number, and when the bonus symbol arranged in a predetermined position among the plurality of the bonus symbols which are arranged in a symbol group to be statically displayed next is determined to be stopped at a predetermined stop position, display a predetermined image on the display while the symbol group to be statically displayed next is being rotationally displayed; and (g) in a case where the total number of the bonus symbol which was statically displayed is more than the predetermined number when each of the plurality of symbol groups is displayed statically, starts a bonus game.

BRIEF DESCRIPTION OF THE DRAWINGS

FIG. 7 is a diagram showing a symbol arrangement table according to the embodiment of the present invention;

FIG. 8 is a flowchart showing a basic game processing executed in the gaming machine according to the embodiment of the present invention;

FIG. 10 is a diagram showing a notice effect modes table according to the embodiment of the present invention.

DETAILED DESCRIPTION OF THE INVENTION

Embodiments of the present invention will be described below with reference to the accompanying drawings.

A gaming machine 13 according to the present invention includes a start switch 25. The CPU 106 (a) generates a random number and starts a basic game corresponding to an input to the start switch 25, (b) rotationally display video reels 3A to 3E displayed on a liquid crystal display 30, (c) determines a position of a symbol statically displayed corresponding to the random number thus generated, (d) statically displays the video reels 3A to 3E which were rotationally displayed in sequence, (e) in a case where a bonus game is statically displayed, display an image corresponding to the total number of the bonus symbol which is statically displayed on the display every time the video reels 3A to 3E are statically displayed, and (f) in a case where the total number of the bonus symbols which were statically displayed is a predetermined number, and when the bonus symbol included in a video reel to be statically displayed next is determined to be stopped at a predetermined stop position, display a predetermined image on the display while the video reel to be statically displayed next is being rotationally displayed.

A game which the gaming machine 13 according to the present invention controls is the game which enters into a bonus game on the condition that three or more bonus symbols appear on the liquid crystal display 30.

Figure 1:
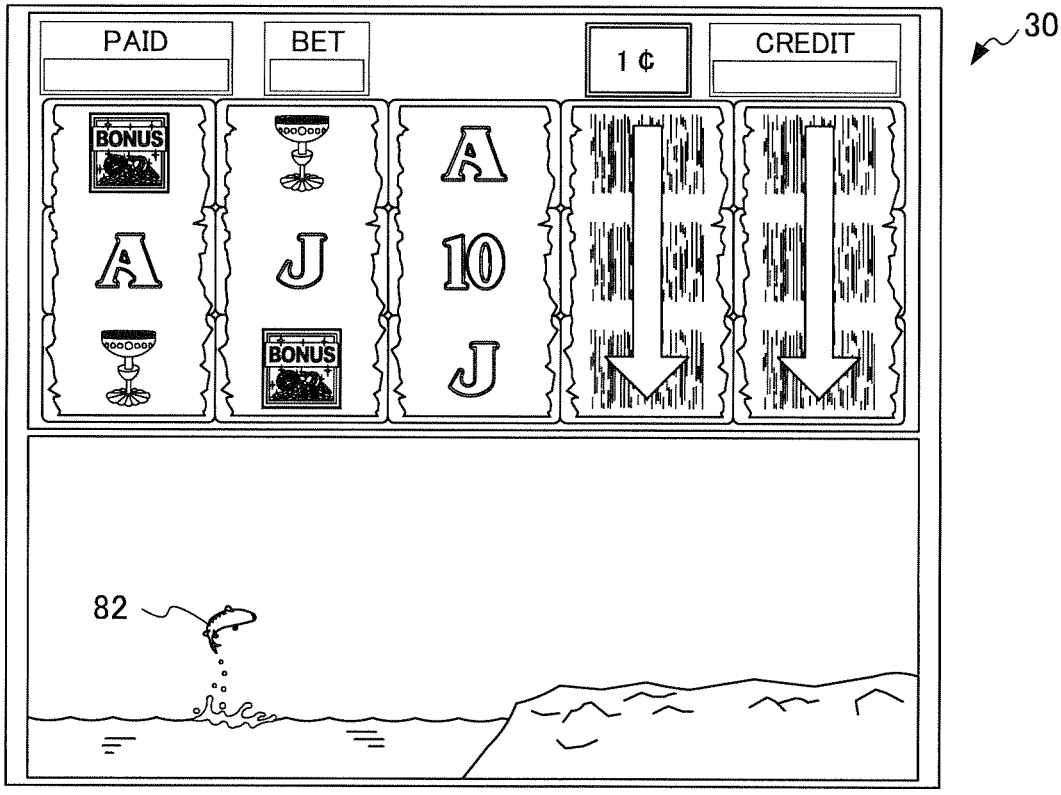
FIG. 1 is an example of the display screen of a visual effect executed in the gaming machine according to the embodiment of the present invention.

Specifically, as shown in FIG. 1, in a case where a part of five video reels is statically displayed and two bonus symbols are statically displayed, which is called bonus reach, and in a case where it has been already determined in an internal configuration that a bonus symbol arranged in a video reel which is stopped next and arranged in a predetermined position of the video reels is statically displayed on the middle line, an image in which a fish 82 jumps out from the sea is displayed as an attraction preview for bonus determination. This image is only displayed when a bonus game is set.

Figure 2:
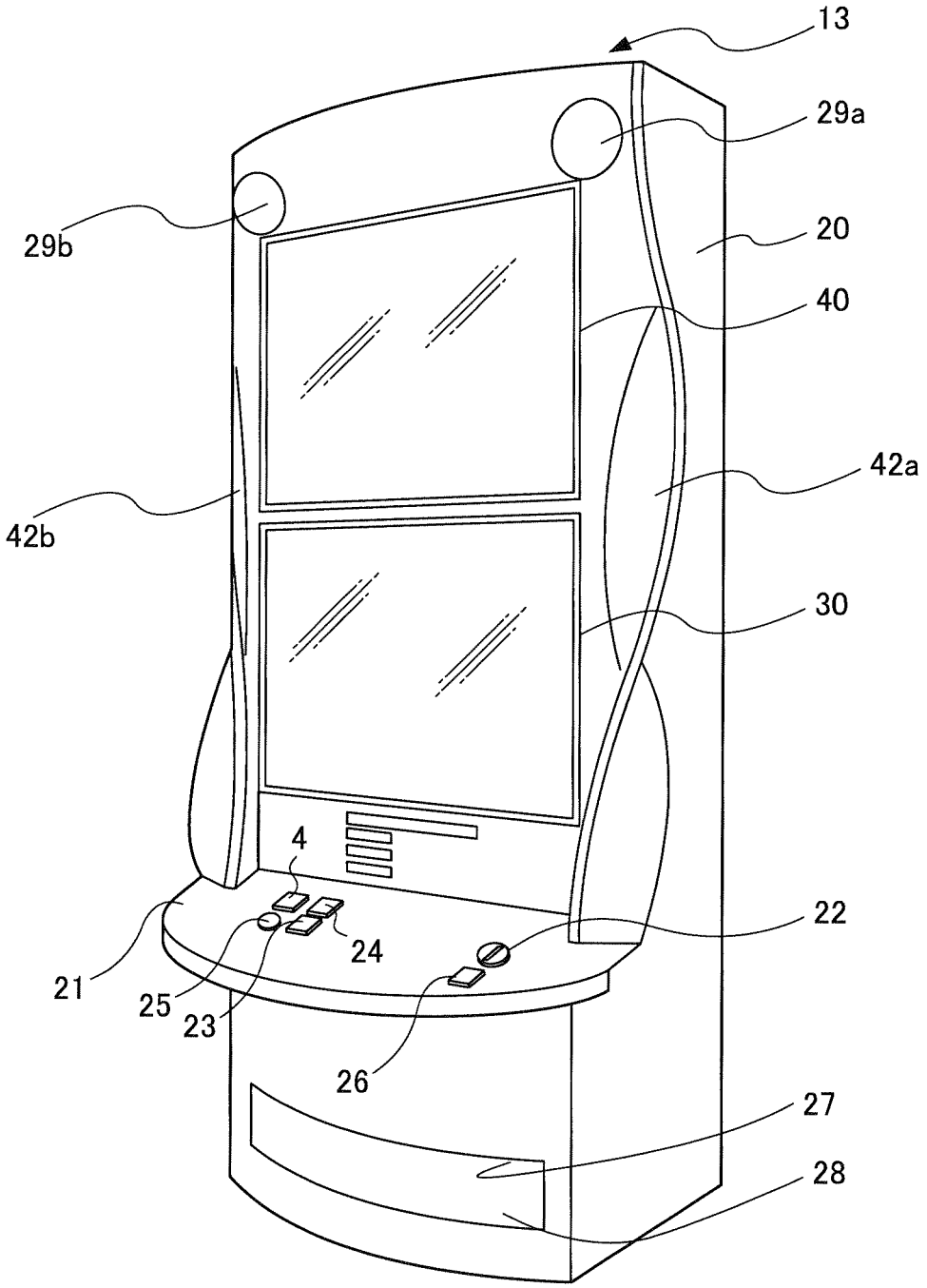
FIG. 2 is a perspective view showing the appearance of the gaming machine according to the embodiment of the present invention.

FIG. 2 is a perspective view showing the gaming machine 13 according to an embodiment of the present invention. The gaming machine 13 includes a cabinet 20. The cabinet 20 has a surface opening towards a player. The cabinet 20 contains various components including a game controller 100 (refer to FIG. 4) for electrically controlling the gaming machine 13, and a hopper 44 (refer to FIG. 4) for controlling the insertion, storage, and payout of coins (being one type of game medium), and the like. The game medium is not limited to coins, and it may be, for example, medals, tokens, electronic money, or electronic valuable information (credits) equivalent to these.

A liquid crystal display 30 is disposed at substantially the center of the front face of the cabinet 20, and a liquid crystal display 40 is disposed above the display 30.

The liquid crystal display 30 realizes a display device for displaying a variety of images related to the game including produced images and the like. The player advances the game while observing the variety of images displayed on the liquid crystal display 30. In such a game, the liquid crystal display 30 displays a slot game as shown in FIGS. 11 to 14.

The gaming machine 13 is made up of video reels, and five virtual reels can be displayed on the liquid crystal display 30. The term "video reels" means ones where image reels in place of mechanical reels are displayed on the liquid crystal display 30. A plurality of types of necessary symbols for the game such as "BONUS," "WILD," "TREASURE BOX," "GOLDEN MASK," "HOLY GRAIL," "COMPASS & MAP," "SNAKE," "A," "K," "Q," "J," and "10" are displayed together with images which appear to be spinning.

The other liquid crystal display 40 above the liquid crystal display 30 is a display functioning as a sub display for displaying the rules of the game, demonstration screens, and the like.

Sound propagation openings 29*a* and 29*b*, through which sound effects emitted from a speaker 41 (refer to FIG. 4) contained inside the cabinet 20 are propagated outside the cabinet 20, are disposed on the upper right and left sides of the liquid crystal display 40, respectively. The sound effects in accordance with the progress of the game or the like can be emitted through the sound propagation openings 29*a* and 29*b*. Decorative lamps 42*a* and 42*b* are disposed on substantially the right and left sides in the middle of the gaming machine 13, respectively. The decorative lamps 42*a* and 42*b* emit light in accordance with the progress of the game.

A substantially horizontal operating part 21 is disposed below the liquid crystal display 30. Disposed on the right side of the operating part 21 is a coin slot 22 through which a number of coins are inserted into the gaming machine 13. On the other hand, disposed on the left side of the operating part 21 are a bet switch 23 and a spin repeat bet switch 24. The bet switch 23 is used to choose the number of coins as a game medium to be bet on lines L1, L2, L3, L4, L5, L6, L7, L8, and L9 for providing nine awards to be described later (hereinafter abbreviated to "winning lines"), any one of which can be determined to be activated, and the activated award is provided. The spin repeat bet switch 24 is used to repeat the game without changing the number of coins bet on any one of the winning lines in the previous game. The number of coins to be bet on the winning lines can be determined by pushing the bet switch 23 or the spin repeat bet switch 24.

In the operating part 21, a start switch 25 for accepting per game the player's operation of starting a game is disposed on the left side of the bet switch 23. Pushing either the start switch 25 or the spin repeat bet switch 24 triggers the start of the game and then displays an image where the five video reels 3A to 3E start to spin.

Furthermore, in the operating part 21, a cash out switch 26 is disposed in the vicinity of the coin slot 22. When the player pushes the cash out switch 26, the inserted coins can be discharged from a coin discharge slot 27 opening into a lower part of the front face of the cabinet 20. The discharged coins can be gathered on a coin tray 28.

Figure 3:
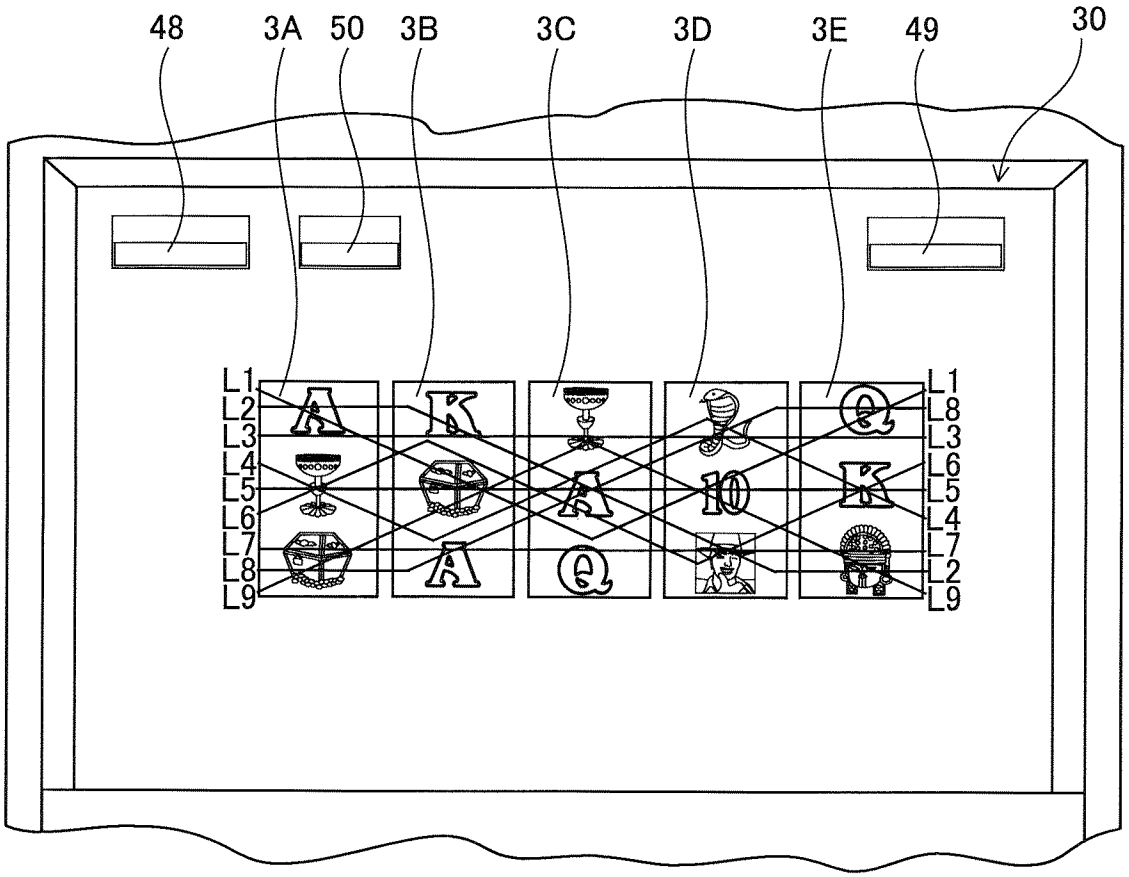
FIG. 3 is an enlarged front view showing an enlargement of a display area of the gaming machine according to the embodiment of the present invention.

FIG. 3 shows an enlargement of a display area of the gaming machine 13. As shown in FIG. 3, the gaming machine 13 has the lines L1 to L9 for providing the nine awards. The lines L1 to L9 extend so as to pass through a symbol on each of the video reels 3A to 3E when the image where all of the spinning five video reels 3A to 3E come to stop is displayed.

Pushing the bet switch 23 once will activate, for example, the line L3 for providing a third award, the line L5 for providing a fifth award, and the line L7 for providing a seventh award, and also take up a coin as a credit medal.

Pushing the bet switch 23 two times will activate, for example, the line L1 for providing a first award, the line L4 for providing a fourth award, and the line L8 for providing an eighth award, in addition to the above-mentioned three lines, and also take up two coins as credit medals.

Pushing the bet switch 23 three times will activate, for example, the line L2 for providing a second award, the line L6 for providing a sixth award, and the line L9 for providing a ninth award, in addition to the above-mentioned six lines, and also take up three coins as credit medals.

An executable game in the present embodiment is a game designed to line up symbols along the winning lines.

A payout number display part 48, a bet number display part 50, and a credit number display part 49 can be arranged to be displayed in this order from the left side on the upper part of the liquid crystal display 30. The payout number display part 48 displays the payout number of coins when a combination for providing an award is achieved along the winning lines. The credit number display part 49 displays the amount of credits of coins stored in the gaming machine 13. The bet number display part 50 displays the bet number that is the number of coins bet on the winning lines.

Figure 4:
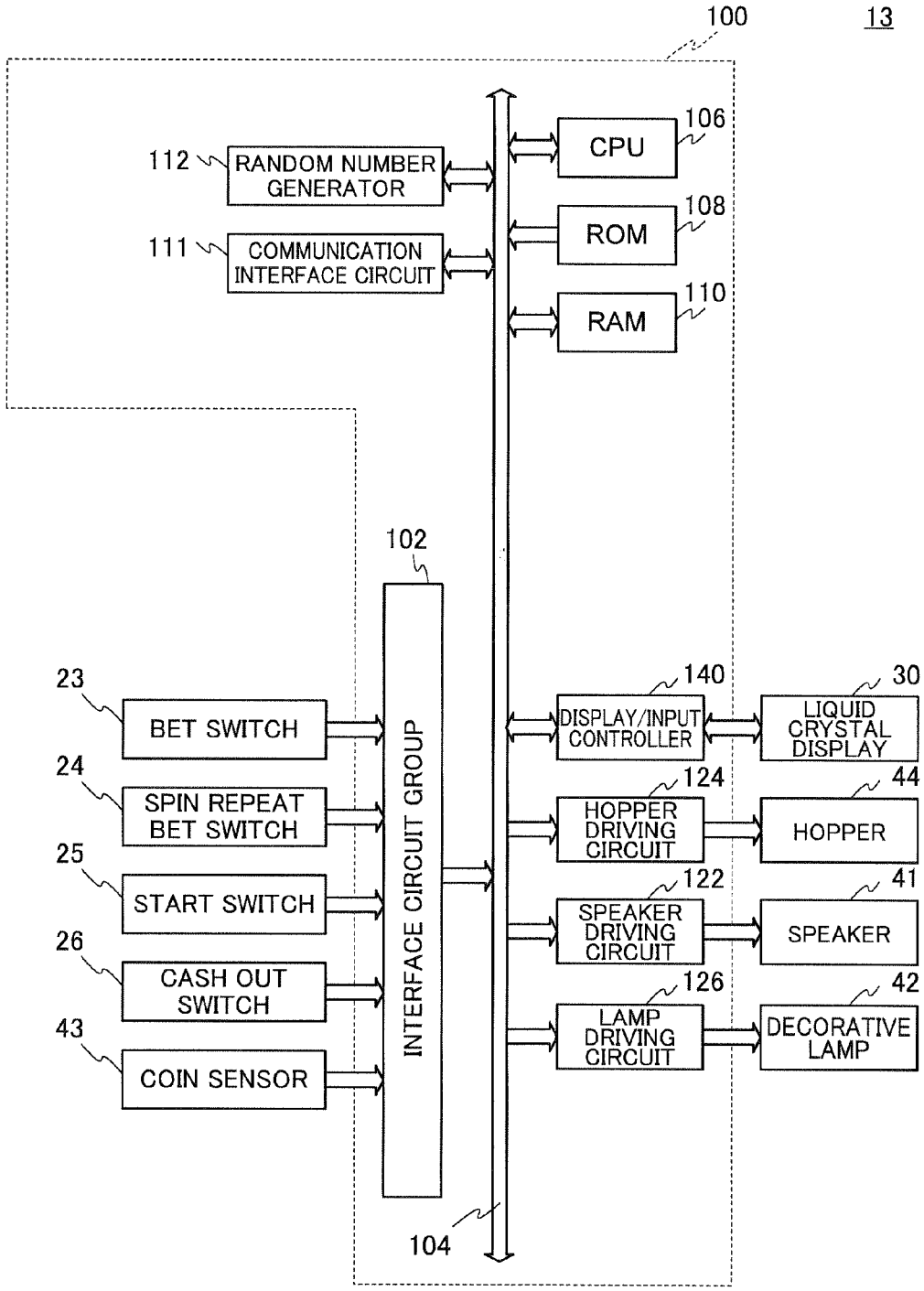
FIG. 4 is a block diagram of a controller of the gaming machine according to the embodiment of the present invention.

FIG. 4 is a block diagram showing the electrical configuration of the game controller 100 of the gaming machine 13. Referring to FIG. 4, the game controller 100 of the gaming machine 13 is a microcomputer and provided with an interface circuit group 102, an input-output bus 104, a CPU 106, a ROM 108, a RAM 110, an interface circuit 111 for communication, a random number generator 112, a speaker drive circuit 122, a hopper drive circuit 124, a lamp drive circuit 126, and a display/input controller 140.

The interface circuit group 102 is connected to the input-output bus 104 performing input and output of data signals or address signals with respect to the CPU 106.

The start switch 25 is connected to the interface circuit group 102. A start signal output from the start switch 25 is converted to a predetermined signal by the interface circuit group 102 and then supplied to the input-output bus 104.

The bet switch 23, the spin repeat bet switch 24, and the cash out switch 26 are also connected to the interface circuit group 102. Switching signals output from the switches 23, 24, and 26, are also supplied to the interface circuit group 102 and converted to predetermined signals and then supplied to the input-output bus 104 by the interface circuit group 102, respectively.

A coin sensor 43 is also connected to the interface circuit group 102. The coin sensor 43 is a sensor for detecting coins inserted into the coin slot 22, and disposed in association with the coin slot 22. A sensing signal output from the coin sensor 43 is also supplied to the interface circuit group 102 and converted to a predetermined signal and then supplied to the input-output bus 104 by the interface circuit group 102.

The ROM 108 and the RAM 110 are connected to the input-output bus 104.

Upon acceptance of the start operation of a game through the start switch 25, the CPU 106 reads a game program to execute the game. The game program is programmed as follows. That is, a display for starting the scroll of the symbols on the five video reels is made on the liquid crystal display 30 via the display/input controller 140. Thereafter, a display for stopping the five video reels is made to rearrange the five video reels. If a combination of stationary symbols at this time is displayed on the winning lines, and the combination corresponds to a specific combination for which a predetermined award is provided, a number of coins associated with the specific combination are paid out.

Figure 9A:
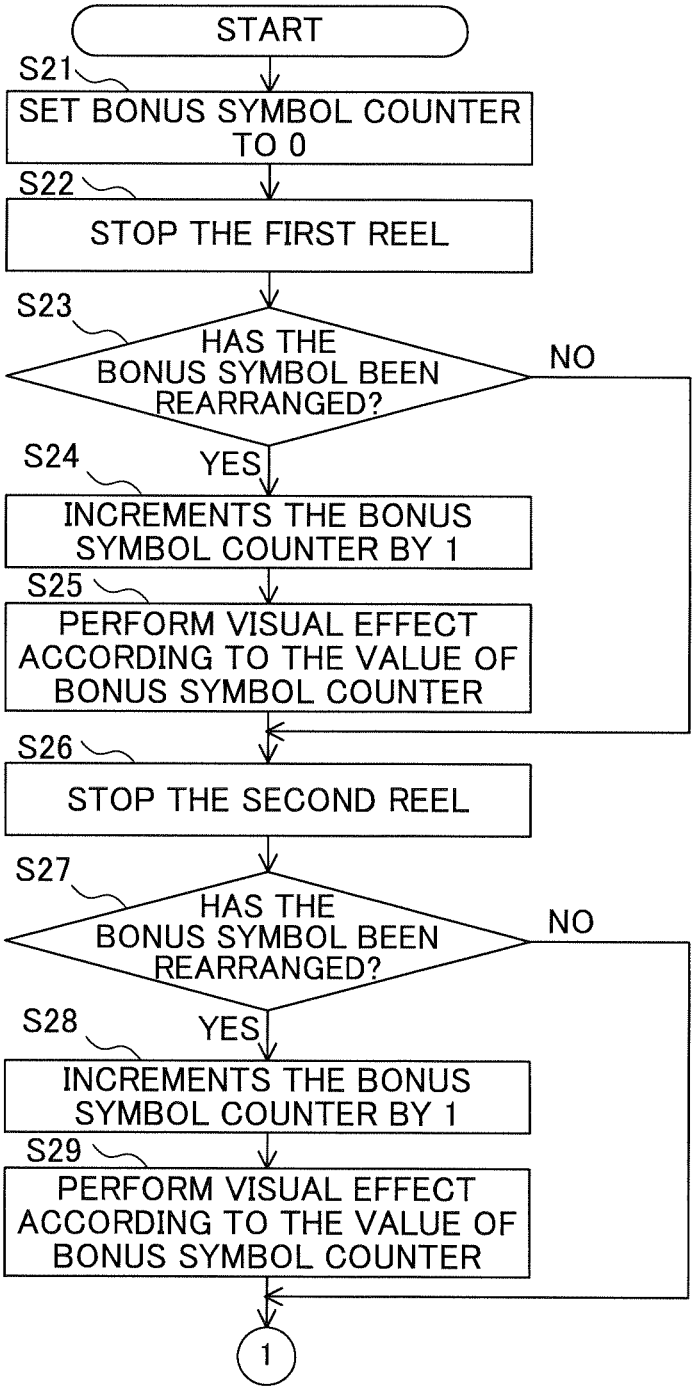
FIGS. 9A to 9D are the flowcharts of processing for stopping rotation of reels executed in the gaming machine according to the embodiment of the present invention.
Figure 9B:
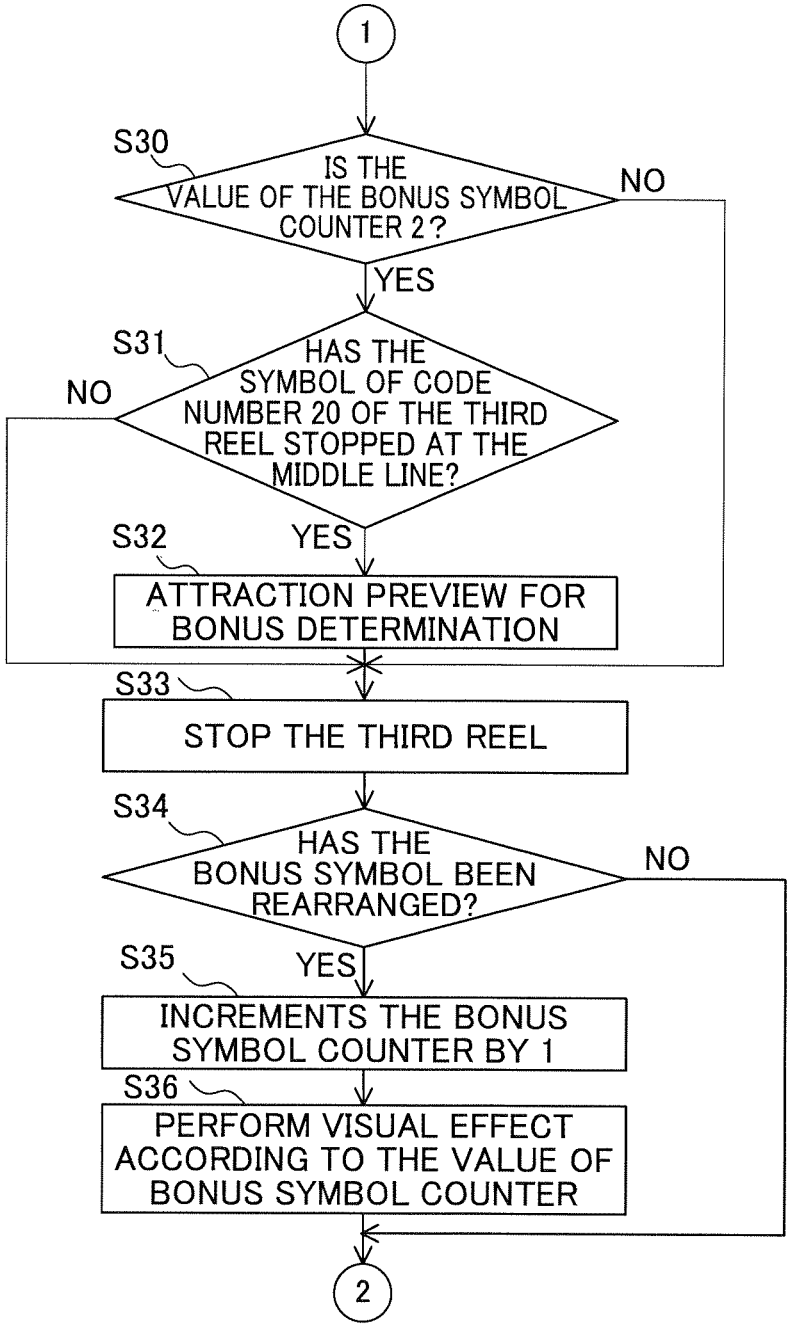
Figure 9C:
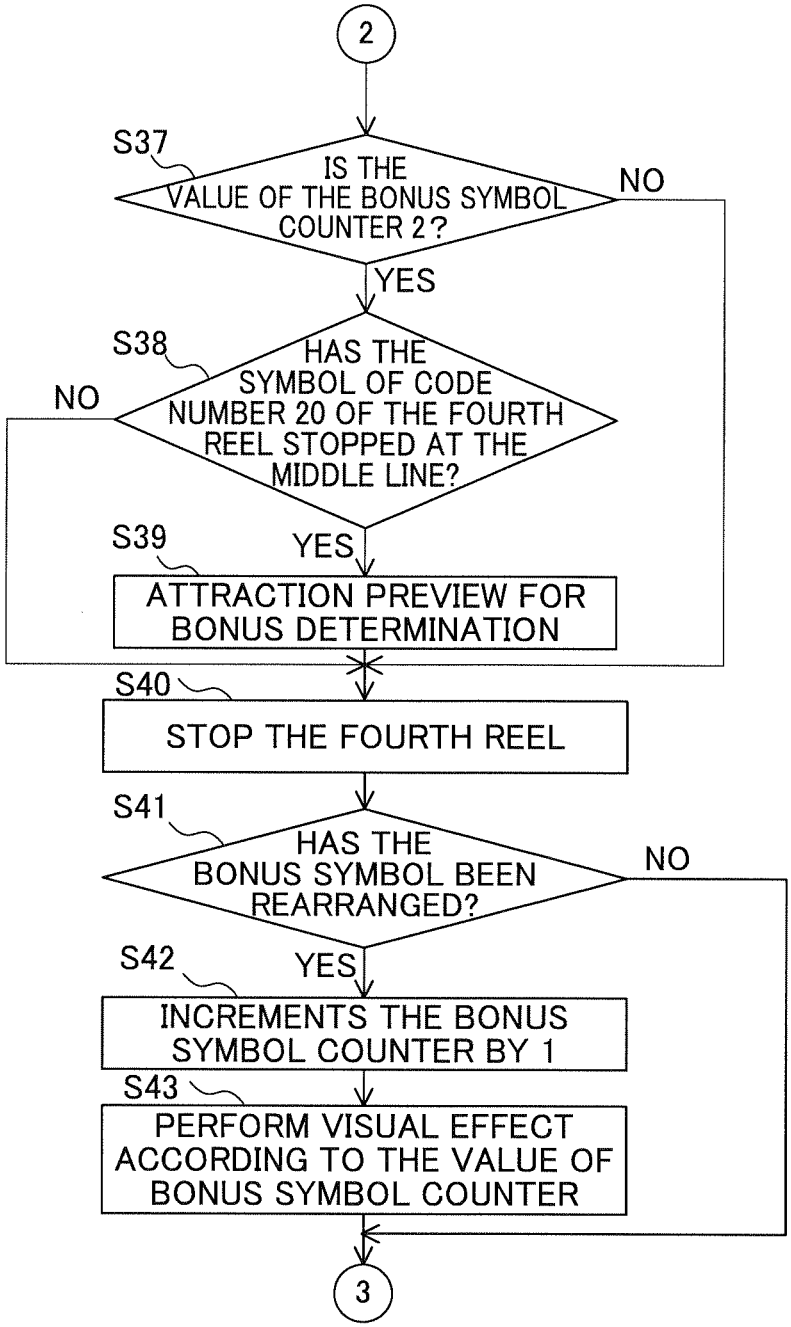
Figure 9D:
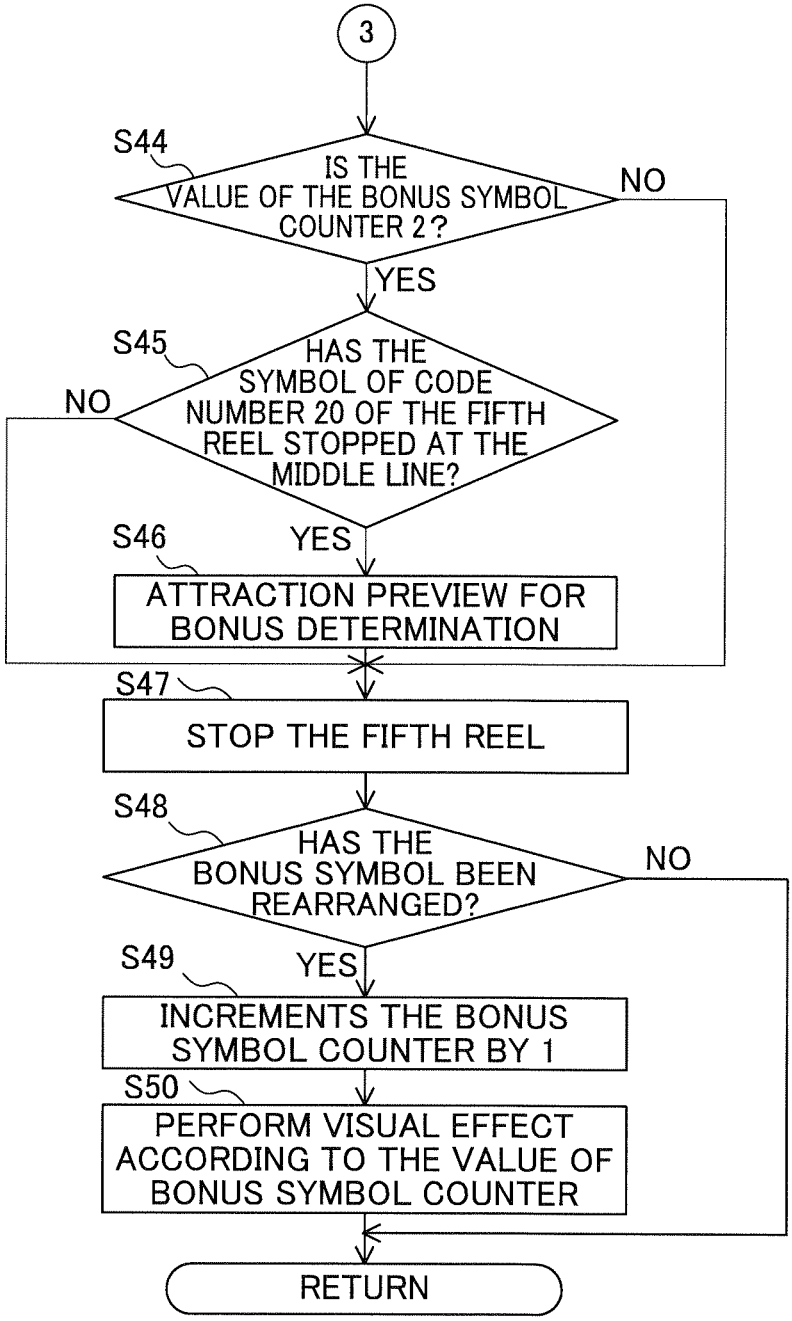

The ROM 108 stores a control program for governing and controlling the gaming machine 13, a program for executing routines as shown in FIG. 8 to 9D (hereinafter referred to as a "routine execution program"), and initial data for executing the control program, and various data tables used in the determination processes. The routine execution program includes the above-mentioned basic game program. As an example of the data tables, there is a table as shown in FIGS. 7 and 10. The RAM 110 temporarily stores the values of flags and variables, and the like used in the control program.

The game program includes processing for determining a stationary symbol. The processing for determining a stationary symbol is used for determining the symbol (code number that corresponds to the symbol) rearranged along the winning line for each reel 3A to 3E. The processing for determining a stationary symbol includes symbol weighting data that corresponds to each of a plurality of types of payout ratios (e.g., 80%, 84%, and 88%). The symbol weighting data is data for each of the five reels 3A to 3E, and indicates the correspondence between the code number of each symbol (see FIG. 7) and one or a plurality of random numbers in a predetermined number range (0 to 256). The payout ratio is determined based upon the payout ratio setting data stored in the ROM 108. A determination of a stationary symbol is performed based upon the symbol weighting data that corresponds to the payout ratio.

The interface circuit 111 for communication is also connected to the input-output bus 104. The interface circuit 111 for communication is a circuit for communication with a central controller 11 and the like over a network 12 including a variety of networks of LAN.

The random number generator 112 for generating random numbers is also connected to the input-output bus 104. The random number generator 112 generates random numbers included in a certain range of numerical values, for example, "0" to "65535 (the sixteenth power of two minus one)". Alternatively, the random numbers may be generated by the arithmetic processing of the CPU 106.

The speaker drive circuit 122 for driving the speaker 41 is also connected to the input-output bus 104. The CPU 106 reads sound data stored in the ROM 108, and sends the read sound data to the speaker drive circuit 122 via the input-output bus 104. This enables the speaker 41 to emit predetermined sound effects.

The hopper drive circuit 124 for driving the hopper 44 is also connected to the input-output bus 104. If a cashout signal from the cash out switch 26 is input, the CPU 106 outputs a drive signal to the hopper drive circuit 124 via the input-output bus 104. This enables the hopper 44 to pay out a number of coins corresponding to the remainder of credits at that point, which is stored in a predetermined memory area of the RAM 110.

Alternatively, the payout of the coins may be performed in a mode of storing credit data in a data card or the like, instead of using physical coins. That is, the player may carry a card functioning as a recording medium, and store the data related to the credit by inserting the card into the gaming machine 13.

The lamp driving circuit 126 for driving the decorative lamps 42*a* and 42*b* is also connected to the input-output bus 104. The CPU 106 sends signals for driving the lamps under a predetermined condition based on the program stored in the ROM 108, to the lamp driving circuit 126. This makes the decorative lamps 42*a* and 42*b* flash or the like.

The display/input controller 140 is also connected to the input-output bus 104. The CPU 106 generates an image display instruction according to the state of the game and the outcome of the game, and outputs the generated image display instruction to the display/input controller 140 via the input-output bus 104. If the image display instruction from the CPU 106 is input, the display/input controller 140 generates a drive signal for driving the liquid crystal display 30 based on the input image display instruction, and outputs the generated drive signal to the liquid crystal display 30. This enables a predetermined image to be displayed on the liquid crystal display 30. The display/input controller 140 also sends, as an input signal, the signal accepted by a touch panel 32 on the liquid crystal display 30, via the input-output bus 104 to the CPU 106. The image display instruction also contains the instructions in accordance with the payout number display part 48, the credit number display part 49, and the bet number display part 50.

Figure 5:
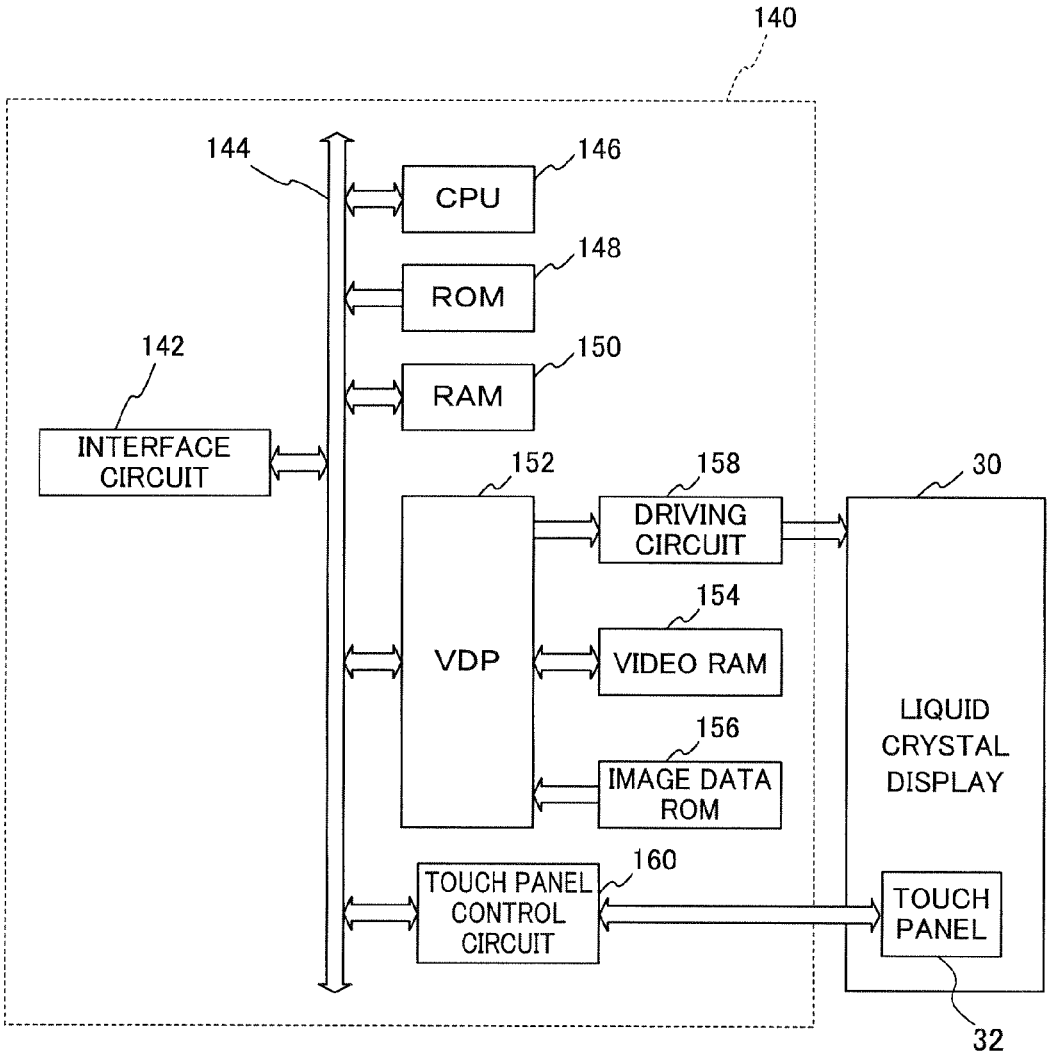
FIG. 5 is a block diagram of a display/input controller of the gaming machine according to the embodiment of the present invention.

FIG. 5 is a block diagram showing the electrical configuration of the display/input controller 140 of the gaming machine 13. The display/input controller 140 is a sub-micro computer which performs image display processing and the control of input from the touch panel 32, and which has an interface circuit 142, an input-output bus 144, a CPU 146, a ROM 148, a RAM 150, a VDP 152, a video RAM 154, a ROM 156 for image data, a drive circuit 158, and a touch panel control circuit 160.

The interface circuit 142 is connected to the input-output bus 144. An image display instruction output from the CPU 106 on the above-mentioned game controller 100 is supplied to the input-output bus 144 via the interface circuit 142. The input-output bus 144 performs input and output of data signals or address signals with respect to the CPU 146.

The ROM 148 and the RAM 150 are connected to the input-output bus 144. The ROM 148 stores a display control program under which a drive signal to be supplied to the liquid crystal display 30 is generated based on the image display instruction from the CPU 106 on the game controller 100. On the other hand, the RAM 150 stores the values of flags and variables used in the control program.

The VDP 152 is also connected to the input-output bus 144. The VDP 152 is a processing unit including a so-called sprite circuit, a screen circuit, and a palette circuit, thus enabling it to perform different processes for displaying images on the liquid crystal display 30. The video RAM 154 and the ROM 156 are connected to the VDP 152. The video RAM 154 stores image data based on the image display instructions from the CPU 106 on the game controller 100. The ROM 156 for image data stores various types of image data containing the above-mentioned produced image data. Further connected to the VDP 152 is the drive circuit 158 which outputs a drive signal for driving the liquid crystal display 30.

By reading and executing the display control program stored in the ROM 148, the CPU 146 instructs the video RAM 154 to store image data to be displayed on the liquid crystal display 30 in response to the image display instruction from the CPU 106 on the game controller 100. The image display instruction contains various types of image display instructions such as the display instructions of the above-mentioned produced image.

The ROM 156 for image data stores various types of image data such as the produced image data.

The touch panel control circuit 160 sends, as an input signal, the signal input through the touch panel 32 on the liquid crystal display 30, via the input-output bus 144 to the CPU 106.

Figure 6:
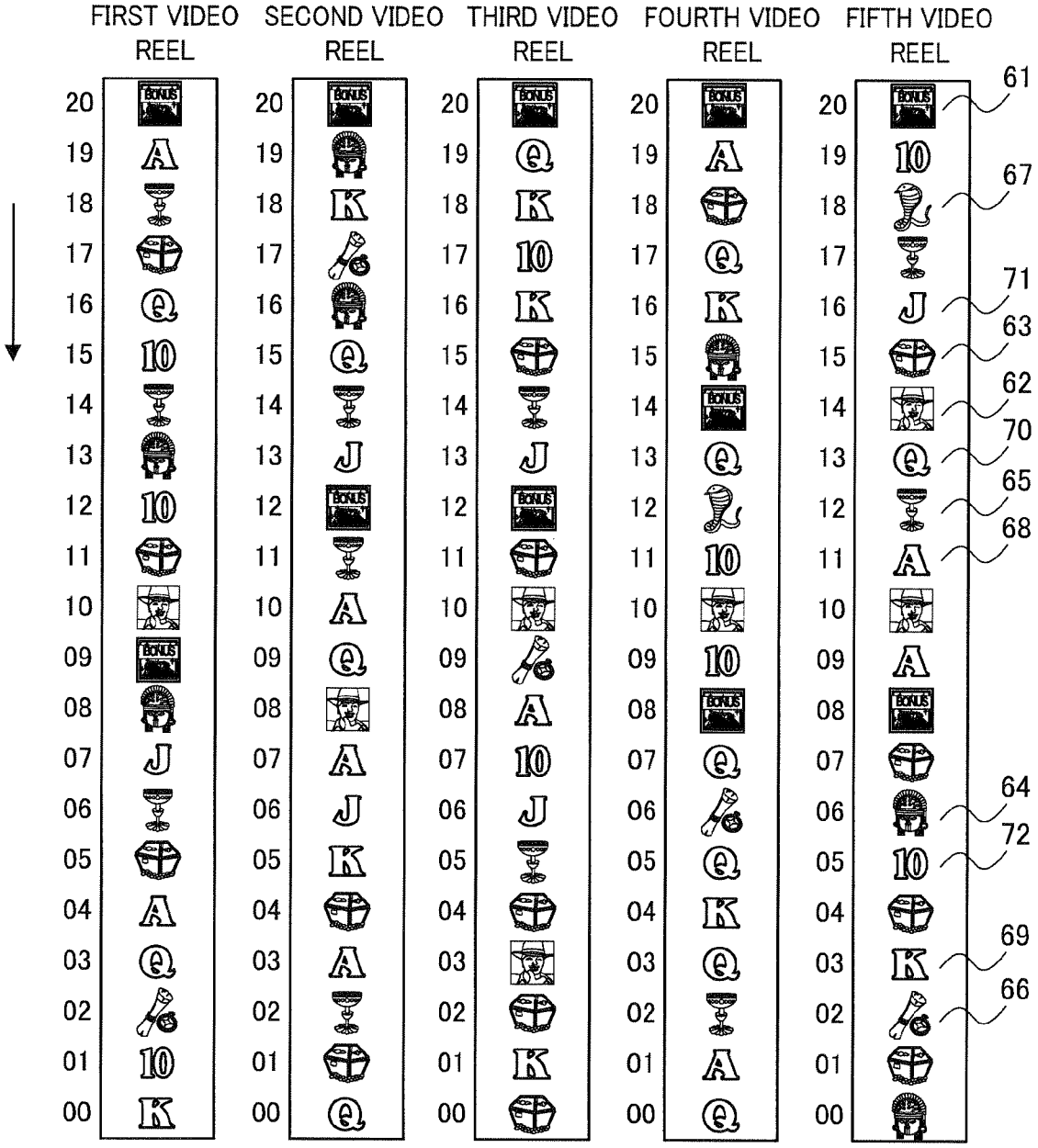
FIG. 6 is a diagram showing symbol lines displayed on the respective video reels of the gaming machine according to the embodiment of the present invention.

FIG. 6 shows symbol lines where 21 symbols are represented and arranged on video reels 3A to 3E, respectively. It should be noted that the symbol line for the first video reel corresponds to the video reel 3A. The symbol line for the second video reel corresponds to the video reel 3B. The symbol line for the third video reel corresponds to the video reel 3C. The symbol line for the fourth video reel corresponds to the video reel 3D. The symbol line for the fifth video reel corresponds to the video reel 3E.

As shown in FIG. 6, the code numbers "00" through "20" are assigned to the respective symbols of the symbol sequences for the video reels 3A through 3E. The code numbers are stored (recorded) in the ROM 108 (FIG. 4) in the form of a data table.

A symbol line is depicted on each of the video reels 3A through 3E. Each symbol sequence includes: a "BONUS" symbol (symbol 61) (which is simply referred to as "BONUS" hereafter); a "WILD" symbol (symbol 62) (which is simply referred to as "WILD" hereafter); a "TREASURE BOX" symbol (symbol 63) (which simply referred to as "TREASURE BOX" hereafter); a "GOLDEN MASK" symbol (symbol 64) (which simply referred to as "GOLDEN MASK" hereafter); a "HOLY GRAIL" symbol (symbol 65) (which is simply referred to as "HOLY GRAIL" hereafter); a "COMPASS & MAP" symbol (symbol 66) (which is simply referred to as "COMPASS & MAP" hereafter); a "SNAKE" symbol (symbol 67) (which is simply referred to as "SNAKE" hereafter); an "A" symbol (symbol 68) (which is simply referred to as "A" hereafter); a "K" symbol (symbol 69) (which is simply referred to as "K" hereafter); a "Q" symbol (symbol 70) (which is simply referred to as "Q" hereafter); a "J" symbol (symbol 71) (which is simply referred to as "J" hereafter); and a "10" symbol (symbol 72) (which is simply referred to as "10" hereafter). Each of the symbol lines on the video reels 3A through 3E is moved by displaying a video image in which the corresponding video reels 3A through 3E are rotated in a forward direction.

In the present embodiment, "BONUS," "WILD," "SNAKE," "TREASURE BOX," "GOLDEN MASK," "HOLY GRAIL," "COMPASS & MAP," "A," "K," "Q," "J," and "10" are provided as hands in providing a predetermined award. The hands (hand data) are basically control information which are the associations between advantages given to a player (the numbers of payout coins) and winning symbol combinations, and which are used to control the stopping of the video reels 3A to 3E, the switching (conversion) of the state of the game, and the supply of coins.

FIG. 7 shows a symbol arrangement table. In the symbol arrangement table, the individual symbols on the video reels 3A to 3E are registered in association with the code numbers designating the positions of the symbols in the symbol lines, respectively. The first to fifth video reels correspond to the video reels 3A to 3E, respectively. In other words, the symbol arrangement table contains the information of the symbols corresponding to the symbol positions (the code numbers) of the video reels 3A to 3E, respectively.

In FIG. 7, "TREASURE," "MASK," and "COMPASS" are abbreviations for the above-mentioned "TREASURE BOX," "GOLDEN MASK," and "COMPASS & MAP," respectively.

FIG. 8 is a flowchart showing the flow of processing in the basic game of the gaming machine 13 to be executed by the game controller 100 of the gaming machine 13. The routine of FIG. 8 is a unit game.

It is supposed that the gaming machine 13 is activated in advance and the variables used in the CPU 106 on the game controller 100 are initialized to predetermined values, thereby providing a stationary action of the gaming machine 13.

First, the CPU 106 on the game controller 100 determines whether there remains a certain credit being the number of remaining coins inserted by the player (Step S1). Specifically, the CPU 106 reads the amount of credits C stored in the RAM 110, and performs processing based on the amount of credits C thus read. When the amount of credits C is "0" (when the result is NO in Step S1), the CPU 106 cannot start any game and hence terminates the present routine without performing any processing. On the other hand, when the amount of credits C is "1" or more (when the result is YES in Step S1), the CPU 106 determines that credit remains, and moves on to Step S2.

In Step S2, the CPU 106 determines whether the spin repeat bet switch 24 has been pushed. When the spin repeat bet switch 24 is already pushed and an operation signal from the switch 24 is then input (when the result is YES in Step S2), the CPU 106 moves on to Step S13. On the other hand, when no operation signal from the switch 24 is input in a predetermined period of time (when the result is NO in Step S2), the CPU 106 determines that the spin repeat bet switch 24 is not pushed, and moves on to Step S3.

In Step S3, a game condition is set. Specifically, the CPU 106 determines the number of coins to be bet on the winning lines in the present game, depending on the operation of the bet switch 23. At this time, the CPU 106 receives operation signals sent in accordance with the operation of the bet switch 23 and, based on the number of the received operation signals, causes the number of bets on the winning lines to be stored in a predetermined memory area of the RAM 110. The CPU 106 reads the amount of credits C written in the predetermined memory area of the RAM 110, and subtracts the amount of credits C thus read from the total number of bets including the aforesaid number of bets. Then, the CPU 106 causes the resulting value to be stored in a predetermined memory area of the RAM 110. The CPU 106 then moves on to Step S4.

In Step S4, the CPU 106 waits for the operation of the start switch 25 by deciding whether the start switch 25 is ON. When the start switch 25 is operated and an operation signal from the start switch 25 is then input (when the result is YES in Step S4), the CPU 106 determines that the start switch 25 has been operated, and then moves on to Step S5.

On the other hand, in Step S13, the CPU 106 determines whether the value of the credit amount C is not less than the value of the total number of bets in the previous game. In other words, the CPU 106 determines whether the game can be started by the operation of pushing the spin repeat bet switch 24. Specifically, when the spin repeat bet switch 24 is pushed and an operation signal is then input from the switch 24, the CPU 106 reads the amount of credits C written in a predetermined memory area of the RAM 110 and the number of bets related to the winning lines L1 to L9 in the previous game, and then performs processing based on the relationship between the amount of credits C thus read and the number of bets thus read, namely whether the value of the credit amount C is not less than the value of the total number of bets in the previous game. When the CPU 106 determines that the former value is less than the latter value (when the result is NO in Step S13), the CPU 106 cannot start any game and hence terminates the present routine without performing any processing. On the other hand, when the former value is not less than the latter value (when the result is YES in Step S13), the CPU 106 subtracts the value of the total number of bets in the previous game from the value of the credit amount C, and causes the resulting value to be stored in a predetermined memory area of the RAM 110. The CPU 106 then moves on to Step S5.

In Step S5, the CPU 106 performs processing for determining a stationary symbol. The specific contents of the processing for determining a stationary symbol are as follows.

First, the CPU 106 extracts a random number from the random number generator 112, and then selects the random number corresponding to each of the five reels 3A to 3E from a random number range of 0 to 255. Then, the CPU 106 reads the payout ratio setting data so as to be stored in the RAM 110, refers to the symbol weighting data corresponding to the payout ratio setting data, and determines code numbers (see FIG. 6) of each reel 3A to 3E based on the five random numbers thus selected. The code number selected for each reel 3A to 3E corresponds to the symbol code number of the symbol which is to be rearranged along the winning line. The CPU 106 determines the code number for each reel 3A to 3E, thereby determining an award. For example, let us consider a case in which the CPU 106 determines that the code numbers for the reels 3A to 3E are "20", "20", "20", "20", and "20". This determination indicates that the CPU 106 has determined that the player wins the "BONUS" award. In addition, when three or more identical symbols are rearranged on the winning line, an award corresponding to the rearranged symbols is achieved.

In the present embodiment, regarding "BONUS", when three or more "BONUS" symbols are rearranged regardless of a winning line, the player wins the "BONUS" award.

After deciding the combination of stationary symbols relating to the winning lines, the CPU 106 determines if the determined combination corresponds to a specific combination for providing a predetermined award. In a case where the combination of the stationary symbols with respect to the active pay lines matches any one of the specified winning combinations, the CPU 106 activates a flag, which indicates that the player has won the award that corresponds to the type of specified winning combination, in order to provide the award that corresponds with the specified winning combination of symbols with respect to the active pay lines thus determined as described above. The flag indicating the provision of the activated award is then stored in a predetermined memory area of the RAM 110 by the CPU 106. On the other hand, when the combination of stationary symbols relating to the winning lines is another combination, namely a non-winning combination, the CPU 106 does not activate the flag indicating the provision of the award. The CPU 106 then moves on to Step S6.

In Step S6, the CPU 106 executes the display of an image where the video reels 3A to 3E start to spin. Specifically, the CPU 106 executes the display of an image where the video reels 3A to 3E spin in sequence or at the same time based on the symbol arrangement table stored in the RAM 110.

The CPU 106 waits until a predetermined period of time has elapsed after displaying an image where the video reels 3A to 3E start to spin (Step S7). When the predetermined period of time has elapsed (when the result is YES in Step S7), the CPU 106 stops automatically the spinning of the video reels 3A to 3E (Step S8). Specifically, based on the specific combination for providing the award written in the predetermined memory area of the RAM 110, the CPU 106 performs a display to stop the images of the spinning video reels 3A to 3E in sequence, so that stationary symbols corresponding to the specific combination for providing the award determined in Step S5 can be displayed in a display area having a visually interactive relationship with the player. The CPU 106 then moves on to Step S9. In addition, reel rotation processing is described with reference to FIGS. 9A to 9D.

In the following Step S9, the CPU 106 determines whether or not a predetermined symbol combination has been formed based upon the results of the combination determination processing performed in Step S5. Specifically, the CPU 106 makes a determination based on the state of the flag indicating the provision of an award relating to the winning lines stored in the predetermined memory area of the RAM 110. When the flag indicating the provision of the award is not activated, namely when the specific combination for providing the award is "others" (when the result is NO in Step S9), the CPU 106 determines that the specific combination for providing the award is not achieved, and terminates the present routine. On the other hand, when the flag is activated, namely when the aforesaid specified combination is other than the "others" (when the result is YES in Step S9), the CPU 106 moves on to Step S10.

In Step S10, the CPU 106 determines whether the achieved symbol combination is "BONUS" by the combination determination processing in Step S5. Specifically, when it is "BONUS" (when the result is YES in Step S10), the CPU 106 moves on to Step S11. On the other hand, when it is not "BONUS" (when the result is NO in Step S10), the CPU 106 moves on to Step S12.

In Step S11, the CPU 106 performs a bonus game processing. More specifically, in the bonus processing, the main CPU 41 starts to perform a bonus game so as to perform a predetermined number of bonus games. The CPU 106 then terminates the present routine.

In Step S12, the CPU 106 pays out a number of coins corresponding to the above-mentioned specific combination for providing the award. Specifically, the CPU 106 refers to a payout table and calculates a payout number of coins corresponding to this specific combination. The CPU 106 reads the amount of credits stored in the predetermined memory area of the RAM 110, and adds the payout number thus calculated to the amount of credits thus read, and then causes the resulting value to be stored in a predetermined memory area of the RAM 110. The CPU 106 also causes the stored value to be displayed on the credit number display part 49. The CPU 106 then terminates the present routine.

The processing for stopping rotation reels is described with reference to FIGS. 9A to 9D.

First, in Step S21 of FIG. 9A, the CPU 106 sets a bonus symbol counter to zero, and moves the processing to Step S22. More specifically, the CPU 106 sets the value of the bonus symbol counter stored in a predetermined area of the RAM 110 to zero.

In Step S22, the CPU 106 stops the first reel 3A and moves the processing to Step S23. More specifically, in processing for determining a stationary symbol in Step S5 of FIG. 8, a symbol corresponding to the code number determined regarding the first reel 3A is rearranged on the winning line L5.

In Step S23, the CPU 106 determines whether a bonus symbol is rearranged or not. In a case of a YES determination, the CPU 106 moves the processing to Step S24. In a case of a NO determination, the CPU 106 moves the processing to Step S26. In Step S24, the CPU 106 increments the bonus symbol counter by 1, and moves the processing to Step S25.

In Step S25, the CPU 106 performs a visual effect according to a value of the bonus symbol counter, and moves the processing to Step S26. More specifically, the CPU 106 refers to a notice effect modes table described later in FIG. 10, determines a notice effect mode according to the value of the bonus symbol counter, and displays an image that provides visual effects on the liquid crystal display 30 via the display/input controller 140.

In Step S26, the CPU 106 stops the second reel 3B, and moves the processing to Step S27. More specifically, according to processing for determining a stationary symbol, in Step S5 of FIG. 8, a symbol corresponding to a code number determined regarding the second reel 3B is rearranged on the winning line L5.

In Step S27, the CPU 106 determines whether a bonus symbol is rearranged or not. In a case of a YES determination, the CPU 106 moves the processing to Step S28. In a case of a NO determination, the CPU 106 moves the processing to Step S30 in FIG. 9B. In Step S28, the CPU 106 increments the bonus symbol counter by 1, and moves the processing to Step S29.

In Step S29, the CPU 106 performs a visual effect according to a value of the bonus symbol counter, and moves the processing to Step S30 in FIG. 9B. The specific processing is similar to that of Step S25 in FIG. 9A.

In Step S30 of FIG. 9B, the CPU 106 determines whether the value of the bonus symbol counter is 2 or not. In a case of a YES determination, the CPU 106 moves the processing to Step S31. In a case of a NO determination, the CPU 106 moves the processing to Step S33.

In Step S31, the CPU 106 determines whether the symbol of the third reel, which has a code number of 20, is stopped at the middle line (at the winning line 5) or not. In a case of a YES determination, the CPU 106 moves the processing to Step S32. In a case of a NO determination, the CPU 106 moves the processing to Step S33. More specifically, in processing for determining a stationary symbol in Step S5 of FIG. 8, the CPU 106 determines whether the code number determined regarding the third reel 3C is 20 or not.

In Step S32, the CPU 106 performs an attraction preview for bonus determination, and moves the processing to Step S33. More specifically, as described later in FIG. 12, the CPU displays an image in which a fish 82 jumps out from the sea on the liquid crystal display 30 via the display/input controller 140.

In addition, the CPU may jump to Step 11 in FIG. 8 so as to execute a bonus game at the time when the attraction preview for bonus determination is performed.

In Step S33, the CPU 106 stops the third reel 3C, and moves the processing to Step S34. More specifically, in processing for determining a stationary symbol in Step S5 of FIG. 8, a symbol corresponding to a code number determined regarding the third reel 3C is rearranged on the winning line L5.

In Step S34, the CPU 106 determines whether a bonus symbol is rearranged or not. In a case of a YES determination, the CPU 106 moves the processing to Step S35. In a case of a NO determination, the CPU 106 moves the processing to Step S37 in FIG. 9C. In Step S38, the CPU 106 increments a value of the bonus symbol counter by 1, and moves the processing to Step S36.

In Step S36, the CPU 106 performs a visual effect according to a value of the bonus symbol counter, and moves the processing to Step S37 in FIG. 9C. The specific processing is similar to that of Step S25 in FIG. 9A.

In Step S37 of FIG. 9C, the CPU 106 determines whether the value of the bonus symbol counter is 2 or not. In a case of a YES determination, the CPU 106 moves the processing to Step S38. In a case of a NO determination, the CPU 106 moves the processing to Step S40.

In Step S38, the CPU 106 determines whether the symbol of the fourth reel, which has a code number of 20, is stopped at the middle line (at the winning line 5) or not. In a case of a YES determination, the CPU 106 moves the processing to Step S39. In a case of a NO determination, the CPU 106 moves the processing to Step S40. More specifically, in processing for determining a stationary symbol in Step S5 of FIG. 8, the CPU 106 determines whether the code number determined regarding the fourth reel 3D is 20 or not.

In Step S39, the CPU 106 performs an attraction preview for bonus determination, and moves the processing to Step S40. More specifically, as described later in FIG. 12, the CPU displays an image in which a fish 82 jumps out from the sea on the liquid crystal display 30 via the display/input controller 140.

In addition, the CPU may jump to Step 11 in FIG. 8 so as to execute a bonus game at the time when the attraction preview for bonus determination was performed.

In Step S40, the CPU 106 stops the fourth reel 3D, and moves the processing to Step S41. More specifically, in processing for determining a stationary symbol in Step S5 of FIG. 8, a symbol corresponding to a code number determined regarding the fourth reel 3D is rearranged on the winning line L5.

In Step S41, the CPU 106 determines whether a bonus symbol is rearranged or not. In a case of a YES determination, the CPU 106 moves the processing to Step S42. In a case of a NO determination, the CPU 106 moves the processing to Step S44 in FIG. 9D. In Step S42, the CPU 106 increments a value of the bonus symbol counter by 1, and moves the processing to Step S43.

In Step S43, the CPU 106 performs a visual effect according to a value of the bonus symbol counter, and moves the processing to Step S44 in FIG. 9D. The specific processing is similar to that of Step S25 in FIG. 9A.

In Step S44 of FIG. 9D, the CPU 106 determines whether the value of the bonus symbol counter is 2 or not. In a case of a YES determination, the CPU 106 moves the processing to Step S45. In a case of a NO determination, the CPU 106 moves the processing to Step S47.

In Step S45, the CPU 106 determines whether the symbol of the fifth reel, which has a code number of 20, is stopped at the middle line (at the winning line 5) or not. In a case of a YES determination, the CPU 106 moves the processing to Step S46. In a case of a NO determination, the CPU 106 moves the processing to Step S47. More specifically, in processing for determining a stationary symbol in Step S5 of FIG. 8, the CPU 106 determines whether the code number determined regarding the fifth reel 3E is 20 or not.

In Step S46, the CPU 106 performs an attraction preview for bonus determination, and moves the processing to Step S47. More specifically, as described later in FIG. 12, the CPU displays an image in which a fish 82 jumps out from the sea on the liquid crystal display 30 via the display/input controller 140.

In addition, the CPU may jump to Step 11 in FIG. 8 so as to execute a bonus game at the time when the attraction preview for bonus determination was performed.

In Step S47, the CPU 106 stops the fifth reel 3E, and moves the processing to Step S48. More specifically, in processing for determining a stationary symbol in Step S5 of FIG. 8, a symbol corresponding to a code number determined regarding the fifth reel 3E is rearranged on the winning line L5.

In Step S48, the CPU 106 determines whether a bonus symbol is rearranged or not. In a case of a YES determination, the CPU 106 moves the processing to Step S49. In a case of a NO determination, the CPU 106 moves the processing to Step S9 in FIG. 8. In Step S49, the CPU 106 increments a value of the bonus symbol counter by 1, and moves the processing to Step S50.

In Step S50, the CPU 106 performs a visual effect according to a value of the bonus symbol counter, and moves the processing to Step S9 in FIG. 8. The specific processing is similar to that of Step S25 in FIG. 9A.

A notice effect modes table is described with reference to FIG. 10. This notice effect modes table is referred to when the CPU 106 determines a notice effect modes table in Steps S25 and S29 of FIG. 9A, Step S36 of FIG. 9B, Step S43 of FIG. 9C, and Step S50 of FIG. 9D. For example, when the value of the bonus symbol counter is 2, the notice effect mode is determined to be "PENGUIN GOES INTO THE SEA".

FIGS. 11 to 14 are diagrams showing images that provide visual effects. In FIGS. 11 to 14, in a display area of the liquid crystal display 30, the images of slot games are displayed on the upper display area and the images that provide visual effects are displayed on the lower display area.

In the present embodiment, when three or more bonus symbols are rearranged, it is determined to proceed to a bonus game. Moreover, each time another bonus symbol is rearranged, an image that provides a visual effect corresponding to the number of the bonus symbols thus rearranged is displayed. In addition, in a case where the bonus symbol which is to be rearranged at the third position is the bonus symbol with the code number 20 and rearranged on the middle line, an attraction preview for bonus determination is performed while the reel of the bonus symbol thus to be rearranged at the third position is rotating.

Figure 11:
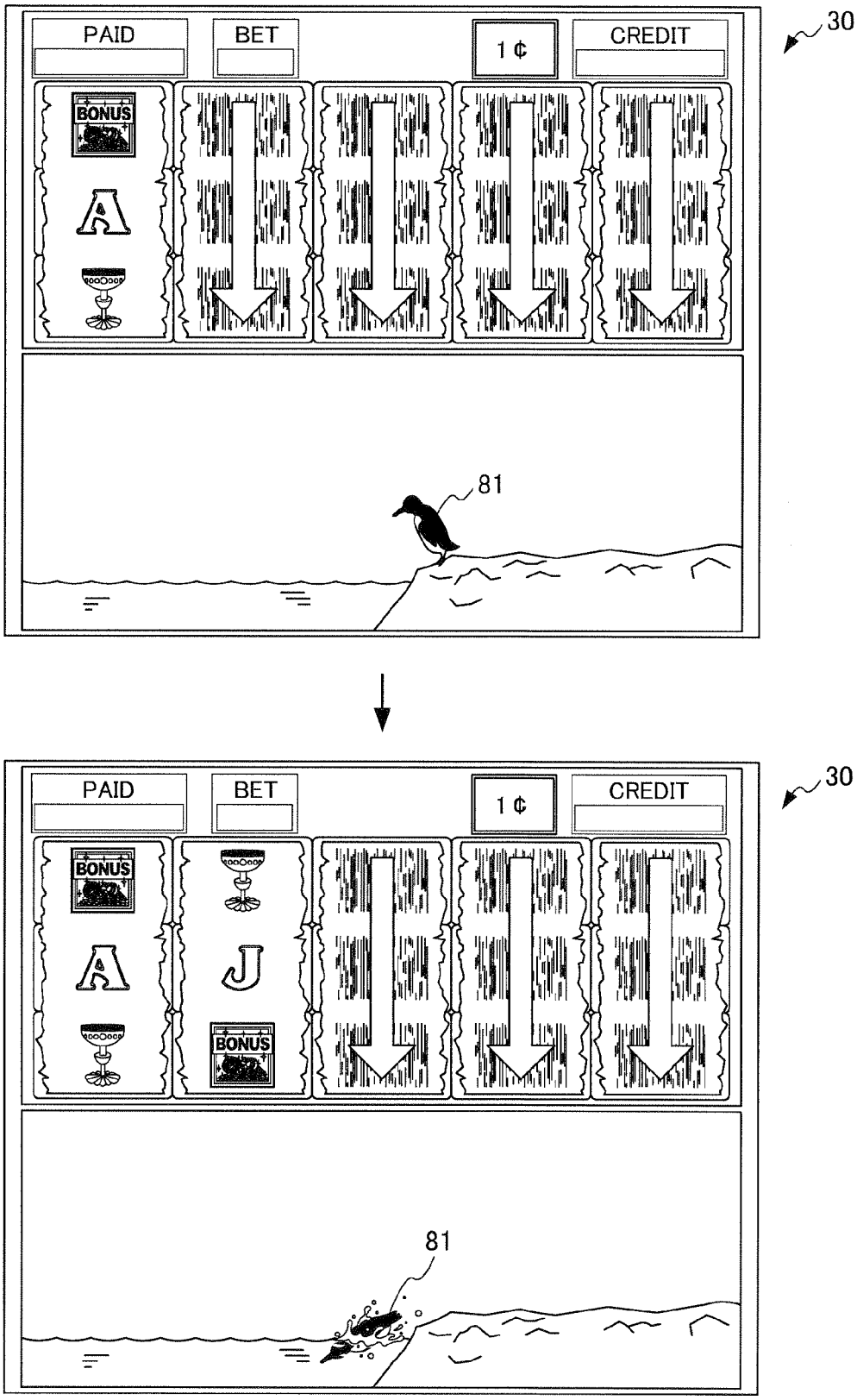
FIGS. 11 to 14 are examples of the display screens of visual effects executed in the gaming machine according to the embodiment of the present invention.

FIG. 11 is a diagram showing the first reel 3A stopped and the second reel 3B stopped in sequence.

According to FIG. 11, when the first reel 3A is stopped, one bonus symbol is rearranged. Consequently, an image of appearance of a penguin 81 is displayed. Next, when the second reel 3B is stopped, the total number of the bonus symbols thus rearranged is 2. Consequently, an image in which a penguin 81 goes into the sea is displayed. Since the total number of the bonus symbols thus rearranged is 2, and thus the image in which the penguin 81 goes into the sea is displayed, the player can recognize that the game is in the state of reach when the game proceeds to a bonus game.

Figure 12:
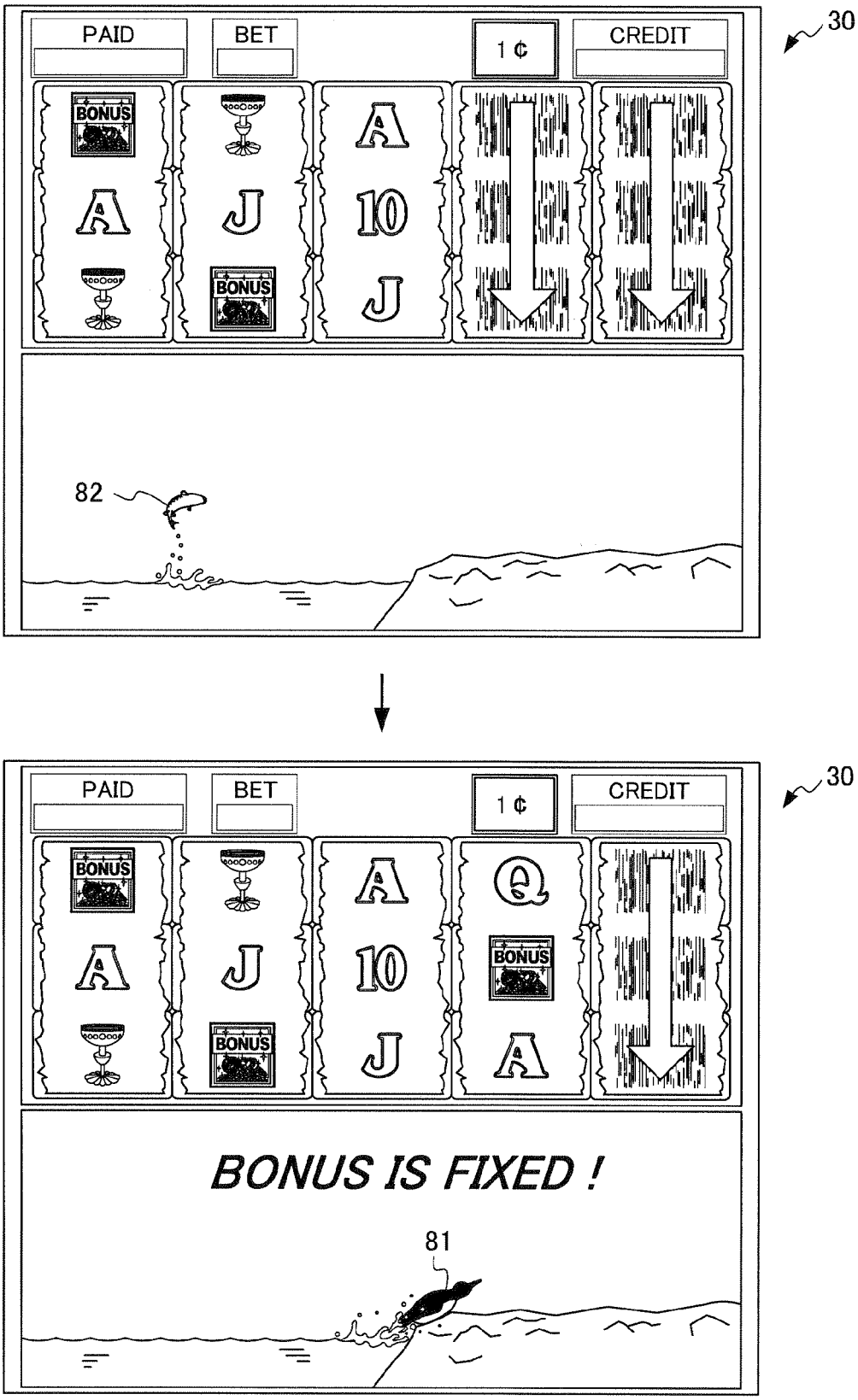

FIG. 12 is a diagram showing that the fourth reel 3D is stopped in a case where the third reel 3C is stopped and the bonus symbol of the fourth reel, which has a code number of 20, is rearranged at the middle line.

According to FIG. 12, when the third reel is stopped, a bonus symbol arranged in the third reel is not rearranged, and the total number of the bonus symbols thus rearranged remains to be 2. At this moment, while the fourth and fifth reels are rotating, since it has already been determined in an internal configuration that the bonus symbol of the fourth reel to be stopped next, which has a code number is 20, is rearranged at the middle line, the image in which the fish 82 jumps out from the sea is displayed as the attraction preview for bonus determination. Since this image is only displayed when a bonus game is set, the player can recognize that the game proceeds to a bonus game even before the total number of the bonus symbols thus rearranged becomes three.

Next, when the fourth reel 3D is stopped, the total number of the bonus symbols thus rearranged becomes three. Consequently, an image in which the penguin 81 jumps out from the sea is displayed. Since the total number of the bonus symbols thus rearranged becomes three, the image in which the penguin 81 jumps out from the sea is displayed with characters "BONUS IS FIXED", and thus the player can recognize that the game is set to proceed to a bonus game.

In addition, a bonus game may be executed when the attraction preview for bonus determination is performed even before the total number of the bonus symbols thus rearranged becomes three.

Figure 13:
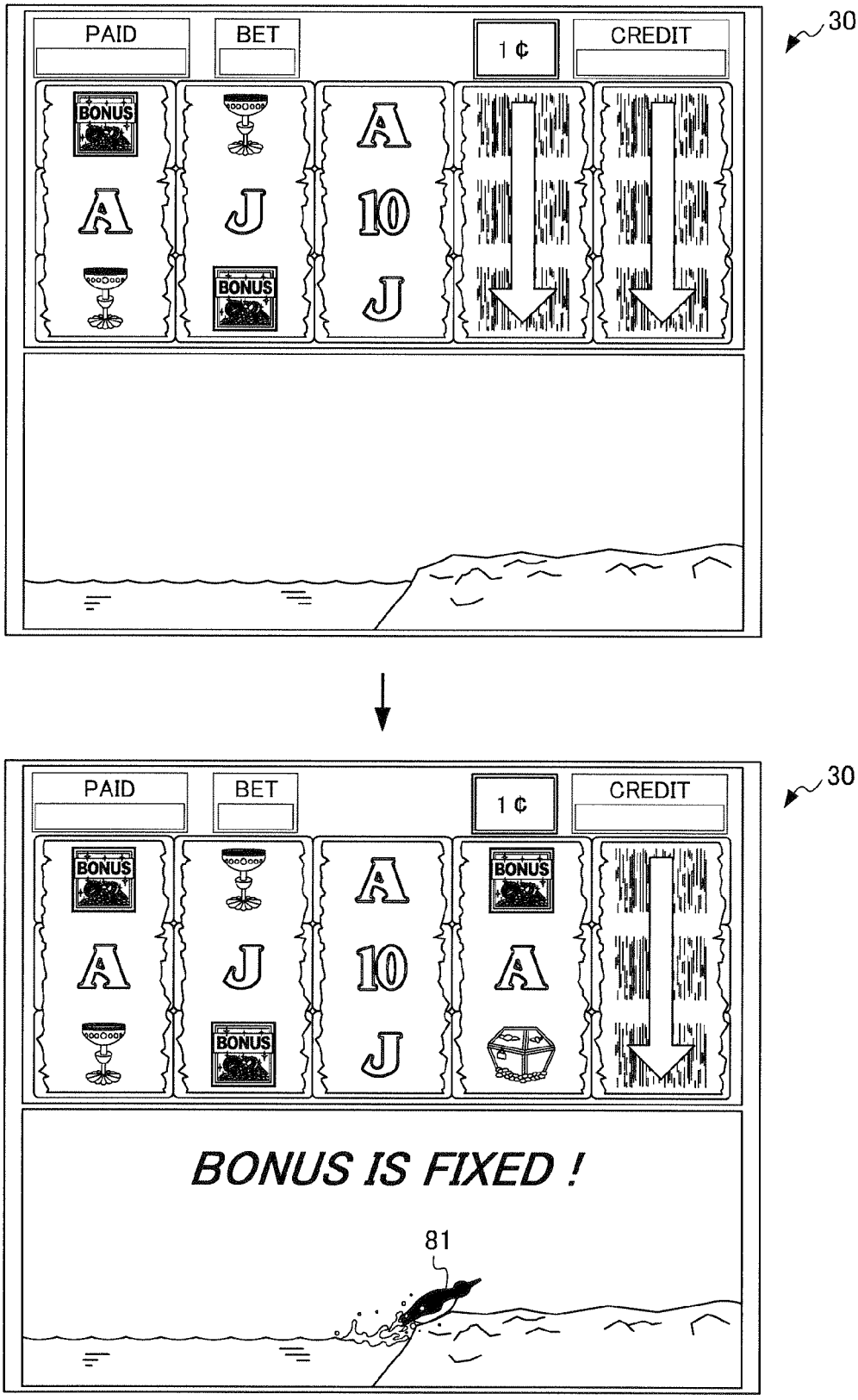

FIG. 13 is a diagram showing the fourth reel 3D stopped in a case where the third reel 3C is stopped and the bonus symbol of the fourth reel, which has a code number of 20, is rearranged at the upper line.

According to FIG. 13, when the third reel is stopped, a bonus symbol arranged in the third reel is not rearranged, and the total number of the bonus symbols thus rearranged remains to be 2. At this moment, while the fourth reel is rotating, it has already been determined that the bonus symbol of the fourth reel, which has a code number of 20, is rearranged at the upper line, not the middle line, and an attraction preview for bonus determination is not performed.

Next, when the fourth reel 3D is stopped, the total number of the bonus symbols thus rearranged becomes three. Consequently, an image in which the penguin 81 jumps out from the sea is displayed. Since the total number of the bonus symbols thus rearranged becomes three, the image in which the penguin 81 jumps out from the sea is displayed with characters "BONUS IS FIXED", and thus the player can recognize that the game is set to proceed to a bonus game.

Figure 14:
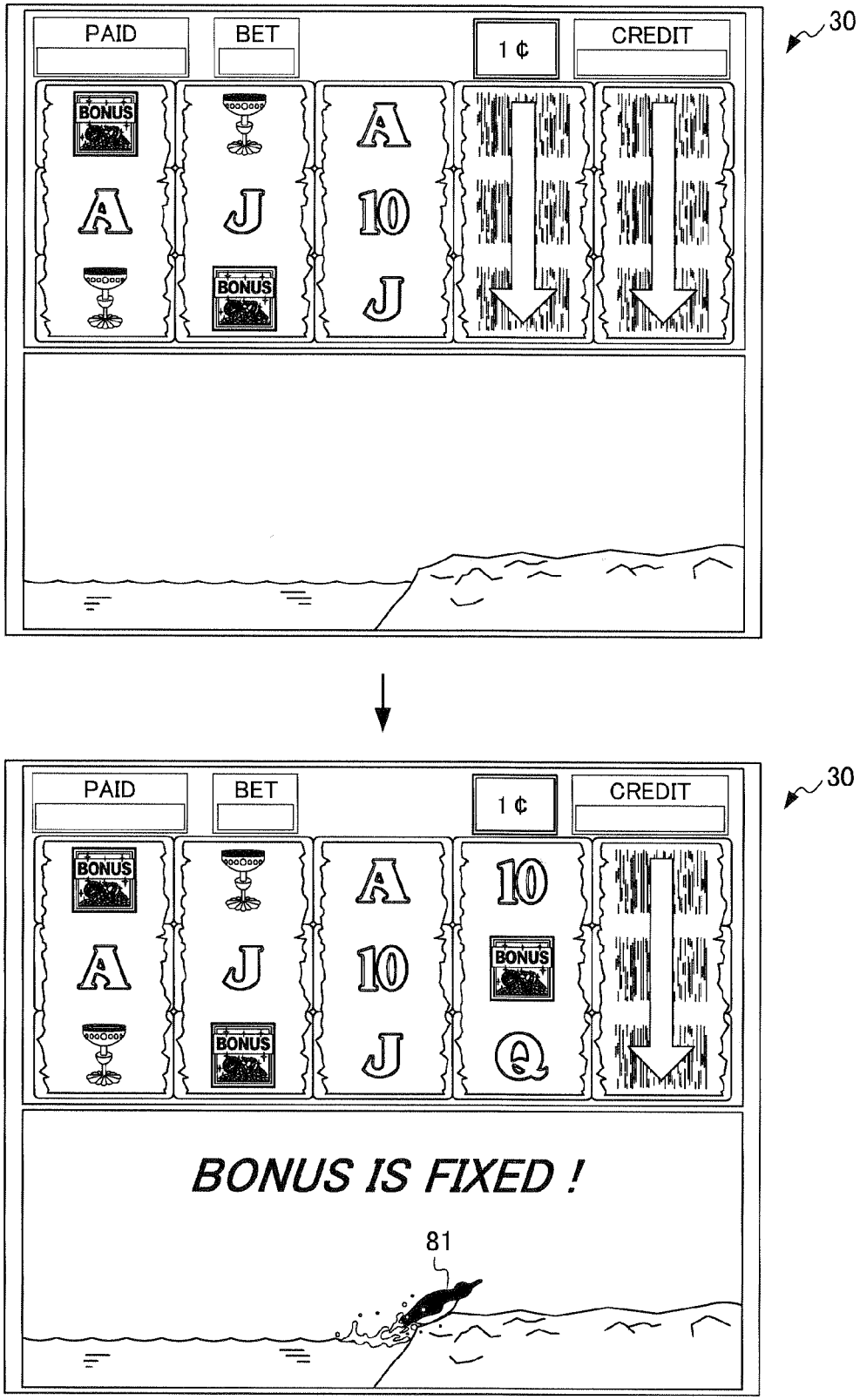

FIG. 14 is a diagram showing the fourth reel 3D stopped in a case where the third reel 3C is stopped and the bonus symbol of the fourth reel, which has a code number of 08, is rearranged at the middle line.

According to FIG. 14, when the third reel is stopped, a bonus symbol arranged in the third reel is not rearranged, and the total number of the bonus symbols thus rearranged remains to be 2. At this moment, while the fourth reel is rotating, it has already been determined that the bonus symbol of the fourth reel, which has a code number of 08, not 20, is rearranged at the middle line, and an attraction preview for bonus determination is not performed.

Next, when the fourth reel 3D is stopped, the total number of the bonus symbol thus rearranged becomes three. Consequently, an image in which the penguin 81 jumps out from the sea is displayed. Since the total number of the bonus symbols thus rearranged becomes three, the image in which the penguin 81 jumps out from the sea is displayed with characters "BONUS IS FIXED", and thus the player can recognize that the game is set to proceed to a bonus game.

While the embodiment of the gaming machine according to the present invention has been described, it is to be understood that the above description is intended to be illustrative, and not restrictive, and any changes in design may be made to specific configurations such as various means. It is also to be understood that the effects described in the foregoing embodiment are intended to be illustrative as an optimum effect that the present invention can produce, and the effects according to the present invention are not limited to those described in the foregoing embodiment.

For example, although in the present embodiment, when three or more bonus symbols are rearranged regardless of a winning line, proceeding to a bonus game is determined, the present invention is not limited thereto. For example, proceeding to a bonus game may be determined only when three or more bonus symbols are rearranged on a winning line.

What is claimed is:

1. A gaming machine, comprising:

a display including a first display area for rotationally displaying each of a plurality of symbol groups having a plurality of symbols and a second display area for displaying a visual effect, the first display area being separated from the second display area;

a plurality of switches configured to start a basic game and to bet a desired amount of credits;

at least one slot configured to receive a game medium providing credits to be bet to play the basic game;

a memory for storing a plurality of visual effects that correspond to total numbers of bonus symbols, respectively; and a controller configured with logic to:

(a1) receive the desired amount of credits as a bet through the switches;

(a) generate a random number and start the basic game corresponding to input to the switches when the desired amount of credits is received as the bet;

(b) rotationally display each of the plurality of symbol groups displayed on the first display area of the display;

(c) determine a position of a symbol to be statically displayed on the first display area of the display corresponding to the random number thus generated;

(d) cause the first display area of the display to statically display in sequence according to a result obtained in (c) each of the plurality of symbol groups which are rotationally displayed;

(e) in a case where a first bonus symbol is statically displayed during a play, display a visual effect, which corresponds to a total number of the bonus symbols of the play statically displayed from among the visual effects, on the second display area of the display every time a symbol group is statically displayed; and (f) in a case where the total number of the bonus symbols in one or more symbol groups which have stopped spinning matches a predetermined number and the controller determines to stop a second bonus symbol included in a next-to-stop-spinning symbol group at a predetermined stop position, display a predetermined image signaling that the basic game is set to proceed to a bonus game on the second display area of the display while the next-to-stop-spinning symbol group is being rotationally displayed, and start the bonus game after the second bonus symbol stops at the predetermined stop position, wherein the first display area includes a plurality of positions including the predetermined stop position, and wherein in a case where the total number of the bonus symbols in one or more symbol groups which have stopped spinning matches the predetermined number and the controller determines to stop the second bonus symbol at any one of the plurality of positions excluding the predetermined stop position in (f), the controller is configured to not display the predetermined image signaling that the basic game is set to proceed to the bonus game while the next-to-stop-spinning symbol group is being rotationally displayed, and then to start the bonus game after the second bonus symbol stops at the any one of the plurality of positions excluding the predetermined stop position.

2. A gaming machine, comprising:

a display including a first display area for rotationally displaying each of a plurality of symbol groups having a plurality of symbols and a second display area for displaying a visual effect, a plurality of bonus symbols being arranged in each of the plurality of symbol groups and the first display area being separated from the second display area;

a plurality of switches configured to start a basic game and to bet a desired amount of credits;

at least one slot configured to receive a game medium providing credits to be bet to play the basic game;

a memory for storing a plurality of visual effects that correspond to total numbers of bonus symbols, respectively; and a controller configured with logic to:

(a1) receive the desired amount of credits as a bet through the switches;

(a) generate a random number and start the basic game corresponding to input to the switches when the desired amount of credits is received as the bet;

(b) rotationally display each of the plurality of symbol groups displayed on the first display area of the display;

(c) determine a position of a symbol to be statically displayed on the first display area of the display corresponding to the random number thus generated;

(d) cause the first display area of the display to statically display in sequence according to a result obtained in (c) each of the plurality of symbol groups which are rotationally displayed;

(e) in a case where a first bonus symbol is statically displayed during a play, display a visual effect, which corresponds to a total number of bonus symbols of the play statically displayed from among the visual effects, on the second display area of the display every time a symbol group is statically displayed; and (f) in a case where the total number of the bonus symbols of the play which have been statically displayed matches a predetermined number and the controller determines to stop a second bonus symbol arranged among the plurality of bonus symbols arranged in the symbol group to be statically displayed next time at a predetermined stop position, display a predetermined image signaling that the basic game is set to proceed to a bonus game on the second display area of the display while the symbol group to be statically displayed next time is being rotationally displayed, and start the bonus game after the second bonus symbols stops at the predetermined stop position, wherein the first display area includes a plurality of positions including the predetermined stop position, and wherein in a case where the total number of the bonus symbols of the play which have been statically displayed matches the predetermined number and the controller determines to stop the second bonus symbol at any one of the plurality of positions excluding the predetermined stop position in (f), the controller is configured to not display the predetermined image signaling that the basic game is set to proceed to the bonus game while the symbol group to be statically displayed next time is being rotationally displayed, and then to start the bonus game after the second bonus symbol stops at the any one of the plurality of positions excluding the predetermined stop position.

3. The gaming machine according to claim 1, wherein the plurality of positions include upper, middle and lower positions with respect to winning lines on the display, and wherein the predetermined stop position comprises one of the upper, middle and lower positions.

4. The gaming machine according to claim 2, wherein the predetermined position among the plurality of the bonus symbols comprises a position identified by a code number that is assigned to each of the plurality of symbols in the symbol group, wherein the plurality of positions include upper, middle and lower positions with respect to winning lines on the display, and wherein the predetermined stop position comprises one of the upper, middle and lower positions.

5. The gaming machine according to claim 1, wherein the total number of the bonus symbols is incremented by 1 when the second bonus symbol stops at any one of the plurality of positions.

6. The gaming machine according to claim 1, wherein the predetermined image is displayed on the second display area only when the controller determines to start a bonus game.

7. The gaming machine according to claim 2, wherein the total number of the bonus symbols is incremented by 1 when the second bonus symbol stops at any one of the plurality of positions.

8. The gaming machine according to claim 2, wherein the predetermined image is displayed on the second display area only when the controller determines to start a bonus game.

9. The gaming machine according to claim 1, wherein the predetermined image is an attraction preview for determination of the bonus game.

10. The gaming machine according to claim 2, wherein the predetermined image is an attraction preview for determination of the bonus game.

* * * * *